US008936451B2

(12) United States Patent
Blackburn

(10) Patent No.: US 8,936,451 B2
(45) Date of Patent: Jan. 20, 2015

(54) ROTARY VANE PUMPS WITH ASYMMETRICAL CHAMBER CAVITIES

(71) Applicant: Gast Manufacturing, Inc., A Unit of IDEX Corporation, Benton Harbor, MI (US)

(72) Inventor: Christopher Lee Blackburn, Saint Joseph, MI (US)

(73) Assignee: Gast Manufacturing, Inc., A Unit of IDEX Corporation, Benton Harbor, MI (US)

( * ) Notice: Subject to any disclaimer, the term of this patent is extended or adjusted under 35 U.S.C. 154(b) by 260 days.

(21) Appl. No.: 13/674,379

(22) Filed: Nov. 12, 2012

(65) Prior Publication Data

US 2013/0177466 A1 Jul. 11, 2013

Related U.S. Application Data

(60) Provisional application No. 61/560,245, filed on Nov. 15, 2011.

(51) Int. Cl.
*F04C 18/344* (2006.01)

(52) U.S. Cl.
CPC ..... *F04C 18/344* (2013.01); *F04C 18/3446* (2013.01); *F04C 18/3441* (2013.01); *F04C 2250/30* (2013.01)
USPC ..... 418/236; 418/209

(58) Field of Classification Search
CPC . F04C 18/344; F04C 18/3446; F04C 2250/30
USPC ..... 418/209, 236
See application file for complete search history.

(56) References Cited

U.S. PATENT DOCUMENTS

| | | | | |
|---|---|---|---|---|
| 4,183,723 | A | 1/1980 | Hansen et al. | |
| 4,629,403 | A | 12/1986 | Wood | |
| 4,737,090 | A | 4/1988 | Sakai et al. | |
| 5,431,552 | A | 7/1995 | Schuller et al. | |
| 5,605,450 | A | 2/1997 | Edwards | |
| 6,533,556 | B1 * | 3/2003 | Cozens et al. | 417/310 |
| 6,637,313 | B1 | 10/2003 | Kerr | |
| 6,862,974 | B2 | 3/2005 | Endoh et al. | |
| 7,051,698 | B2 | 5/2006 | Ollis | |
| 7,114,931 | B2 | 10/2006 | Wilk et al. | |
| 7,493,885 | B2 | 2/2009 | Peitzke et al. | |
| 2005/0031479 | A1 | 2/2005 | Takahashi et al. | |

FOREIGN PATENT DOCUMENTS

JP 57191489 A * 11/1982 ..... F04C 18/344

* cited by examiner

*Primary Examiner* — Mary A Davis
(74) *Attorney, Agent, or Firm* — Miller, Matthias & Hull LLP

(57) ABSTRACT

Rotary vane pumps include casings having asymmetrical cavities that accommodate a rotor. For a single pump chamber, one portion of the rotor abuts or nearly abuts the inner wall of the cavity at a single location while one portion of the rotor and the inner wall are not in contact with each other thereby defining a pump chamber. For a dual pump chamber embodiment, two diametrically opposed portions of the rotor abut or nearly abut the inner wall of the cavity while two portions of the rotor and inner wall are not in contact with each other thereby defining the two pump chambers. The two pump chambers are disposed on opposite sides of the minor axis of the cavity. The cavities of each pump are skewed so each pump chamber is larger in volume at the inlet end than at the outlet end.

11 Claims, 21 Drawing Sheets

ROTARY VANE PUMPS WITH ASYMMETRICAL CHAMBER CAVITIES

CROSS-REFERENCE TO RELATED APPLICATION

This is a non-provisional application claiming priority under 35 U.S.C. 119(e) to U.S. Provisional Patent Application Ser. No. 61/560,245 filed on Nov. 15, 2011.

TECHNICAL FIELD

This disclosure relates generally to a system and method for improving the performance of rotary vane pumps.

BACKGROUND

A rotary vane pump is a positive-displacement pump that consists of vanes slidably mounted to a rotor that rotates inside of a cavity formed by a pump casing. In some cases, the vanes can be of variable length and/or spring-biased to maintain contact with the inner wall of the cavity as the rotor rotates. The simplest rotary vane pump includes a cylindrical rotor rotating inside of a larger cylindrical cavity. The axes of these two cylinders are offset, causing an eccentricity. Vanes are allowed to slide into and out of the rotor and seal against the inner wall of the cavity, creating rotating vane chambers disposed between two vanes. The rotor may engage or be disposed close to the inner wall at one point which creates a single pump chamber extending around the rotor and from a single inlet to a single outlet.

However, other rotary vane pumps are designed with an elliptical cavity formed in the pump casing with a cylindrical rotor. The rotor may engage or be disposed close to the inner wall at two points along opposite ends of the minor axis of the ellipse, which creates two pump chambers (or "twin pump chambers") on opposite sides of the minor axis and along the portions of the inner wall near the major axis. Such a design includes two inlet/outlet pairs, one for each pump chamber.

At the inlet of each pump chamber, the inner wall that defines the cavity extends away from the rotor and causes the vanes to extend outward as the vane chambers increase in volume as the rotor and the vane chambers rotate away from the inlet towards the outlet. As the vane chambers pass the inlet, the vane chambers are filled with fluid drawn in through the inlet at inlet pressure, which may be atmospheric. At the outlet of the pump chamber, the inner wall extends towards the rotor, the vanes retract and the vane chambers therefore decrease in volume as the vane chambers rotate to the outlet, forcing the fluid out of the pump. For pumps with twin chambers, the above process is repeated twice for each rotation of the rotor. With a constant inlet pressure, the vane chambers deliver the same volume of fluid with each rotation. Multi-stage rotary vane vacuum pumps can attain pressures as low as $10^{-3}$ mbar (0.1 Pa).

The elliptical/twin chamber rotary vane pump design allows both sides of the rotor to generate pressure or vacuum, thus achieving greater flow in a smaller package size and because the pump chambers are disposed 180° from each other, side loading of the rotor is virtually eliminated. However because the cycle of each vane chamber of an elliptical vane pump is only 180° of rotation as opposed to 360° for a single chamber vane pump, at higher vacuum and pressure duties, there is not enough angular distance to effectively compress the fluid before it is exhausted without restricting the flow and increasing vane loading. The result is a pump having shorter vane life and that becomes louder, hotter, and less efficient as the pressure or vacuum is increased.

Similarly, like the twin chamber rotary vane pump design, the internal compression of single chamber rotary vane pumps is limited by the angular distance between the inlet and exhaust ports. Therefore, achieving higher pressure duties in single chamber rotary vane pumps also adversely affects sound levels, efficiency, heat, and vane life.

SUMMARY OF THE DISCLOSURE

By altering the shape of the elliptical cavity, the angle of maximum vane extension may be shifted away from the major axis of the ellipse to a position closer to the inlet. As a result, the angular distance between the inlet and outlet is increased allowing greater internal compression. Further adjustment of the inner wall curvature allows optimization of the vane acceleration where the average vane tip load can be reduced and vane "skipping" or loss of contact with the inner wall can be eliminated. The resulting pumps are quieter, cooler, more efficient and provide a longer vane life.

In one example, a rotary vane pump is disclosed that comprises a casing comprising an asymmetrical cavity having a continuous inner wall. The cavity has a minor axis and a major axis for purposes of this description, even though it is asymmetrical. The pump also comprises a rotor disposed within the cavity for rotation within the cavity. During a rotation, two diametrically opposed portions of the rotor abut or nearly abut the inner wall of the cavity at or near the minor axis of the cavity while two portions of the rotor and inner wall are not in contact with each other thereby defining two pump chambers disposed on opposite sides of the minor axis. Each pump chamber comprises an inlet end and an outlet end. The inlet ends, disposed in different pump chambers, are on opposite sides of the minor axis and on opposite sides of the major axis. The outlet ends, disposed in different pump chambers, are on opposite sides of the minor axis and on opposite sides of the major axis. Each pump chamber is larger in volume between the inlet end and the major axis than between the major axis and the outlet end. In other words, the inlet portion of each pump chamber is larger than the outlet portion of each pump chamber.

In a refinement, the rotor includes a plurality of slots ranging from about three to about 12 with each slot accommodating a vane. In a further refinement of this concept, the rotor comprises about eight slots and about eight vanes.

In another refinement, the angle between each of the two diametrically opposed portions of the rotor abutting or nearly abutting the inner wall of the cavity at or near the minor axis of the cavity and the inner wall of the cavity in each chamber where each vane is fully extended as it engages the inner wall ranges from less than about 90° to about 50°, depending on the length of maximum vane extension. In a further refinement of this concept, the angle between each of the two diametrically opposed portions of the rotor abutting or nearly abutting the inner wall of the cavity at or near the minor axis of the cavity and the inner wall of the cavity in each chamber where each vane is fully extended as it engages the inner wall is about 80°.

Another rotary vane pump is disclosed which comprises a casing comprising an asymmetrical cavity having a continuous inner wall. The pump also comprises a rotor disposed within the cavity for rotation within the cavity. During a rotation, the rotor abuts or nearly abuts the inner wall of the cavity at a single location with a remaining portion of the rotor not in contact with the inner wall of the cavity. The remaining portion of the rotor and the inner wall not in contact with each other defines a pump chamber. The pump chamber comprises an inlet end and an outlet end. The inlet end and outlet end are disposed on opposite sides of the portion of the rotor abutting or nearly abutting the inner wall of the cavity at a single location. The pump chamber side with the inlet end is larger in volume than the pump chamber side with the outlet end. In other words, the inlet portion of the pump chamber is larger than the outlet portion of the pump chamber.

In a refinement, the rotor comprises a plurality of slots ranging from about three to about eight with each slot accommodating a vane. In a further refinement of this concept, the rotor comprises about four slots and about four vanes.

In a refinement, the angle between the portion of the rotor abutting or nearly abutting the inner wall of the cavity at a single location and the inner wall of the cavity at the inlet end of the pump chamber where each vane is fully extended as it engages the inner wall ranges from less than 180° to about 100, depending on the length of maximum vane extension. In a further refinement of this concept, the angle between the portion of the rotor abutting or nearly abutting the inner wall of the cavity at a single location and the inner wall of the cavity at the inlet end of the pump chamber where each vane is fully extended as it engages the inner wall is about 125°.

A method of increasing internal compression of a rotary vane pump is disclosed. The method providing a casing comprising an asymmetrical cavity having a continuous inner wall. The cavity has a minor axis and a major axis. The method also includes disposing a rotor within the cavity for rotation within the cavity so that, during a rotation, two diametrically opposed portions of the rotor abut or nearly abut the inner wall of the cavity at or near the minor axis of the cavity while two portions of the rotor and inner wall are not in contact with each other and thereby define two pump chambers disposed on opposite sides of the minor axis. The method also includes providing each pump chamber with an inlet end and an outlet end. The inlet ends are disposed in different pump chambers on opposite sides of the minor axis and on opposite sides of the major axis. The outlet ends are disposed in different pump chambers on opposite sides of the minor axis and on opposite sides of the major axis. Finally, the method comprises providing the asymmetrical cavity so that each pump chamber is larger in volume between the inlet end and the major axis than between the major axis and the outlet end.

Another method for increasing the internal compression of a rotary vane pump is disclosed. The method comprises providing a casing comprising an asymmetrical cavity having a continuous inner wall. The method includes disposing a rotor within the cavity for rotation within the cavity, so that during a rotation, the rotor abuts or nearly abuts the inner wall of the cavity at a single location with a remaining portion of the rotor not in contact with the inner wall of the cavity. The remaining portion of the rotor and the inner wall not in contact with each other defines a pump chamber. The method also includes providing the pump chamber with an inlet end and an outlet end. The inlet end and outlet end are disposed on opposite sides of the portion of the rotor abutting or nearly abutting the inner wall of the cavity at a single location. The pump chamber side with the inlet end is larger in volume than the pump chamber side with the outlet end.

DESCRIPTION

Figure 1:
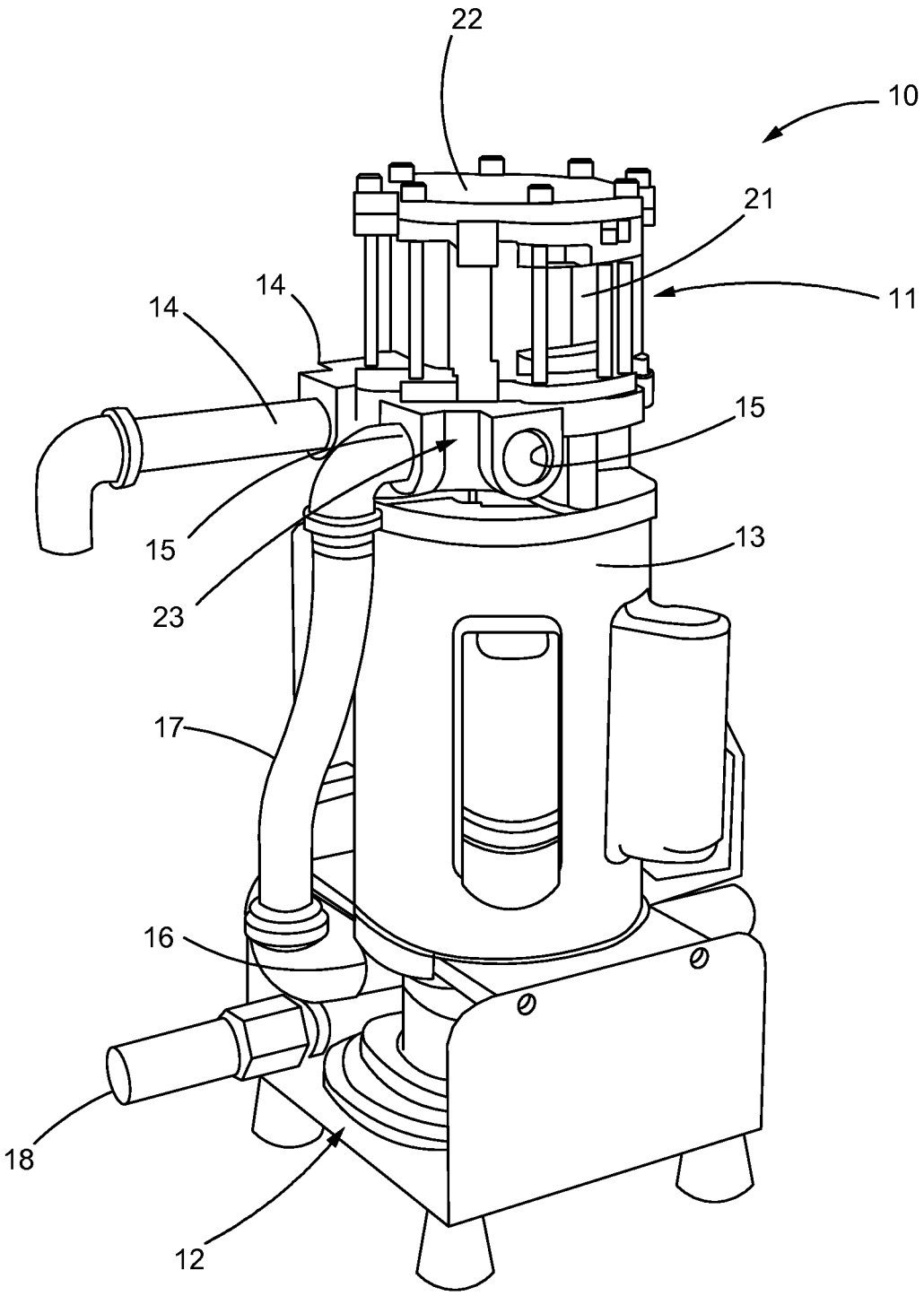
FIG. 1 is a perspective view of a combination suction and liquid separation apparatus that includes the disclosed rotary vane pump.

FIG. 1 is a perspective view of a suction/liquid separator 10, typically used in dental applications. As shown in FIG. 1, the combination suction/liquid separator 10 includes a pump 11, which is one of the disclosed rotary vane pumps discussed in detail below, a liquid separator 12 and a motor 13 for operating the pump 11 and separator 12. The pump 11 may include a pair of suction inlets 14 (see FIG. 2) and a pair of outlets 15. The outlet 15 may also be connected to an air discharge 16 via a hose or pipe 17. The solids outlet is shown at 18. The pump 11 includes a casing 21 enclosed by a cover 22. The head plate 23 includes the inlets 14, outlets 15 and also serves to enclose the casing 21.

Returning to FIG. 2 the fasteners 25 connect the cover 22 to the pump casing 21. The pump casing 21 is connected to the head plate 23 via the fasteners 33. While the head plate 23 includes two inlets 14 and two outlets 15, typically, only one inlet 14 and only one outlet 15 is used at a time. The rotor 26 includes a plurality of sliding vanes 27 and is disposed in the cavity 28 of the pump casing 21. The bearing plate 29 disposed below the head plate 23 accommodates the bearing 31 and rotor shaft 32. The rotor shaft 32 is frictionally coupled to the rotor 26 within the axial opening 34 in the rotor 26.

Figure 2:
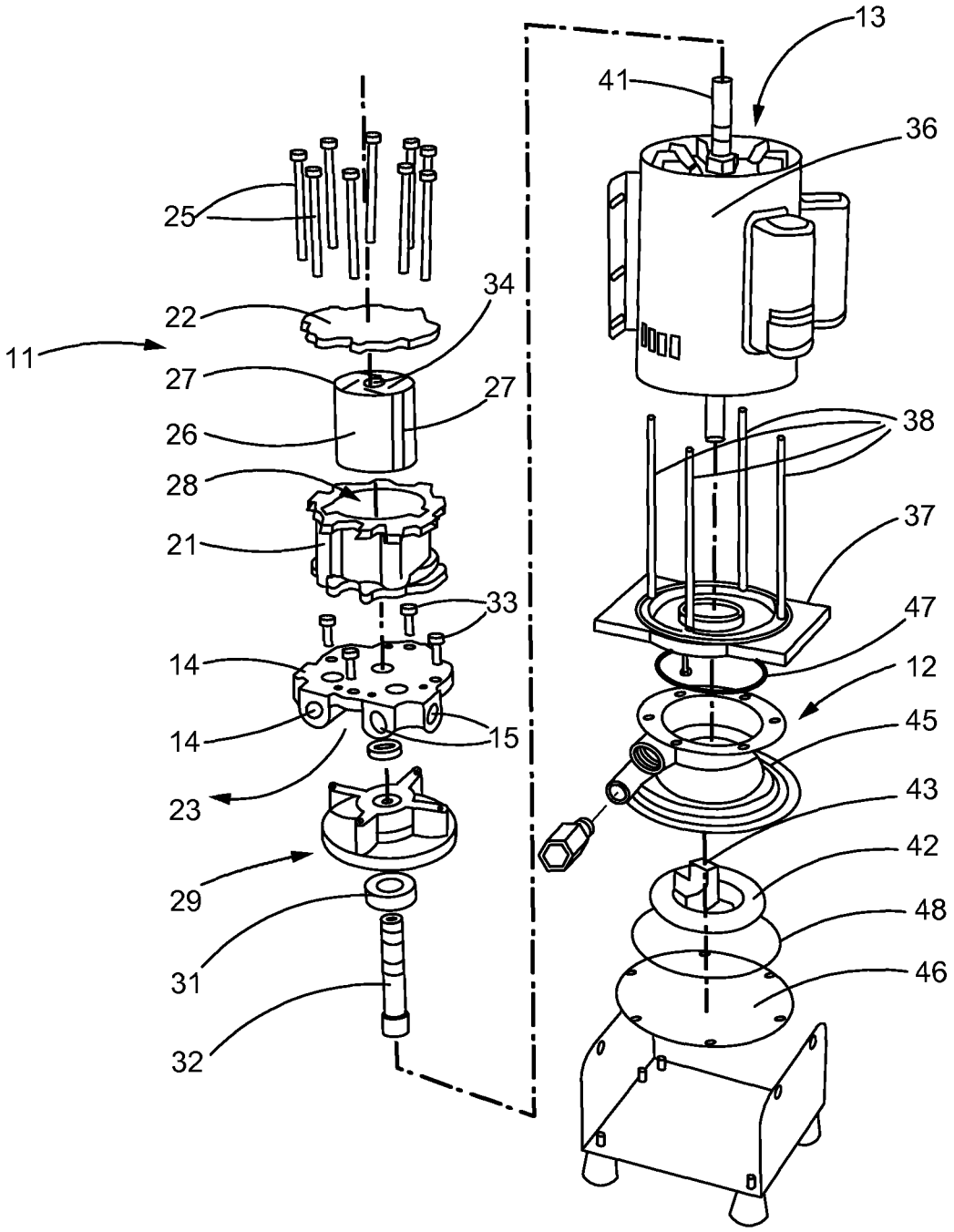
FIG. 2 is an exploded view of the apparatus shown in FIG. 1.

Still referring to FIG. 2, the motor 13 includes a motor housing 36 and a base plate 37 that is connected to the bearing plate 29 with the elongated fasteners or threaded rods 38. The motor 13 also includes a drive shaft 41. The lower end of the drive shaft 41 is coupled to the separator rotor 42 via a tongue-in-groove connection, splined connection or similar connection in the axial opening 43 of the separator rotor 42. The separator 12 includes a housing 45 that is sandwiched between the separator base plate 46 and the motor base plate 37. Sealing elements or O-rings are shown at 47, 48.

Figure 3:
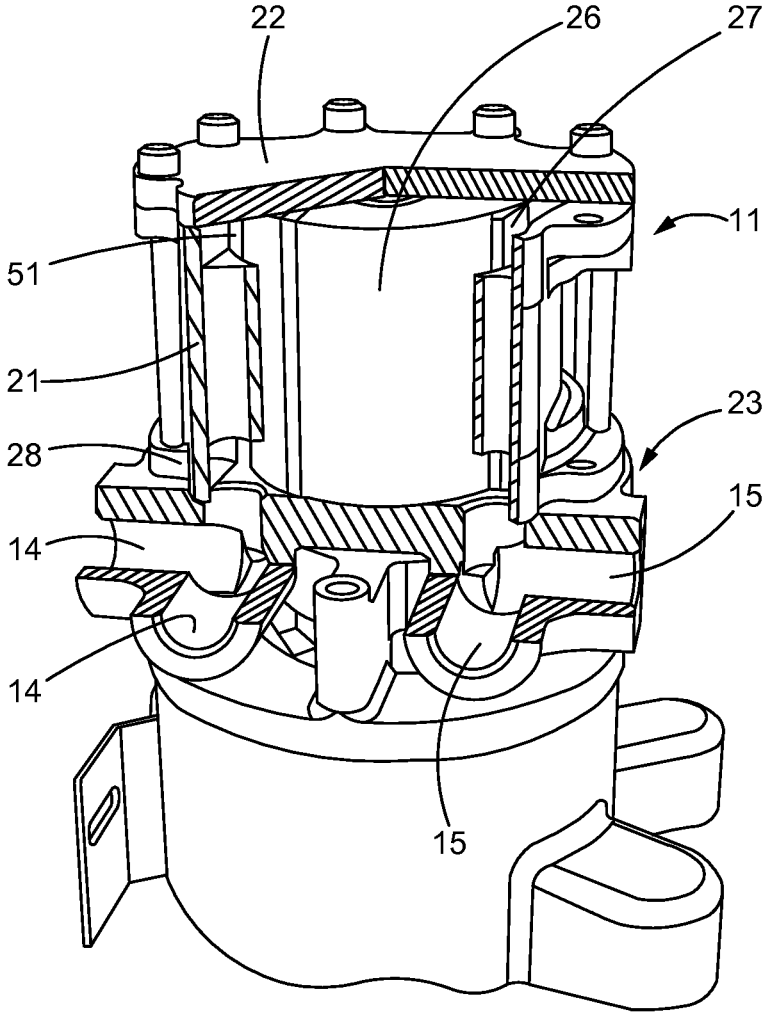
FIG. 3 is a partial perspective and sectional view of the apparatus illustrated in FIGS. 1-2, particularly illustrating the rotor and casing of the disclosed rotary vane pump.
Figure 4:
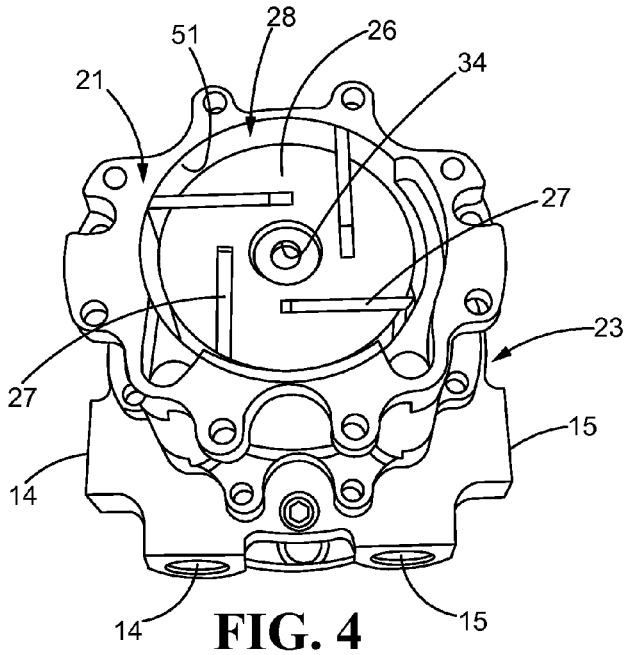
FIG. 4 is a top perspective view of the rotary vane pump and apparatus illustrated in FIG. 3, with the top cover or upper cap removed thereby exposing the rotor, vanes and cavity.

FIGS. 3-4 illustrate the position of rotor 26 within the pump casing 21 and between the cover 22 and head plate 23. One of the vanes 27 is extended outward from the rotor 26 to engage the inner wall 51 (see also FIG. 4) of the cavity 28. FIG. 3 also illustrates communication between the inlets 14, outlets 15 and the cavity 28, which may be defined by the cover 22, the inner wall 51 of the cavity 28 and the head plate 23. In FIG. 4, the rotor 26 includes four sliding vanes 27. The number of vanes 27 may vary as will be apparent to those skilled in the art and as illustrated in FIGS. 4, 8-9, 12-13, 18-19, and 22-25.

Figure 5:
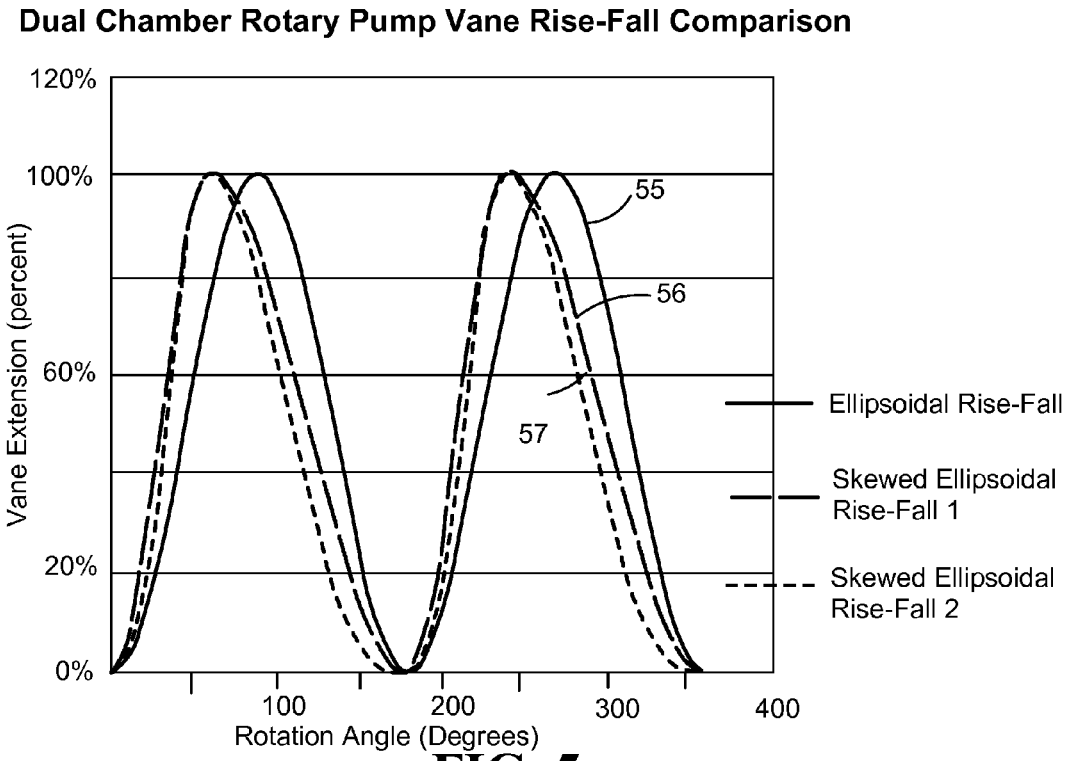
FIG. 5 graphically illustrates the benefits of altering the shape of an ellipsoidal cavity for skewing the shape of an ellipsoidal cavity as the curves show that vanes of pumps with a skewed ellipsoidal cavity extend sooner and retract sooner during a pump cycle than the vanes of a conventional pump.
Figure 6:
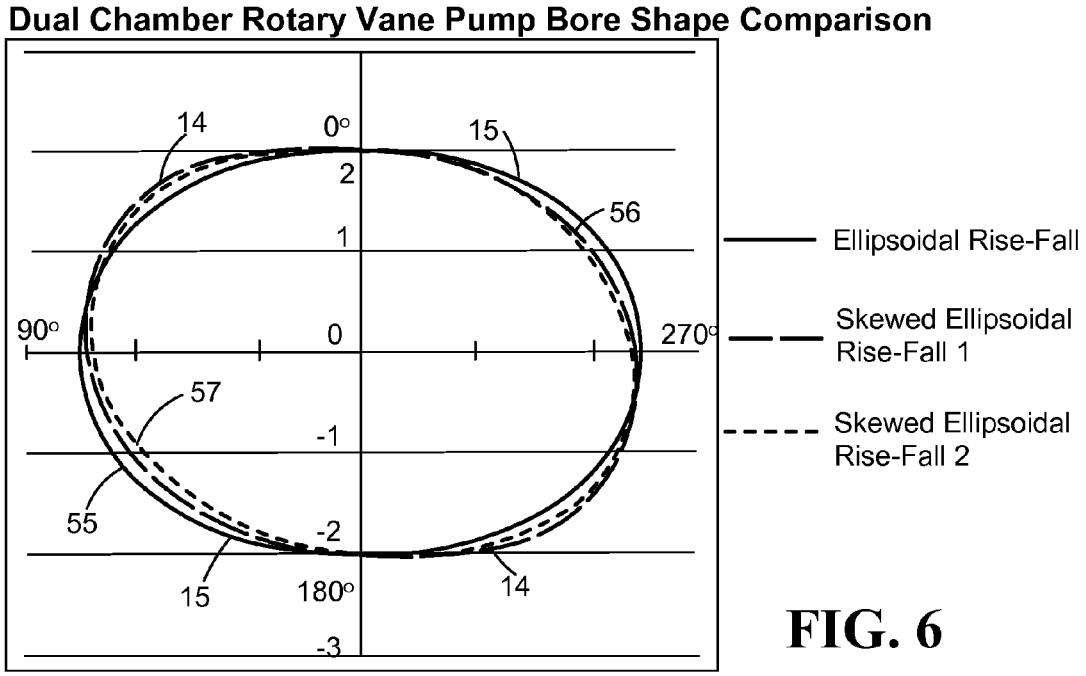
FIG. 6 graphically illustrates the shapes of the three cavities referred to in FIG. 5.
Figure 7:
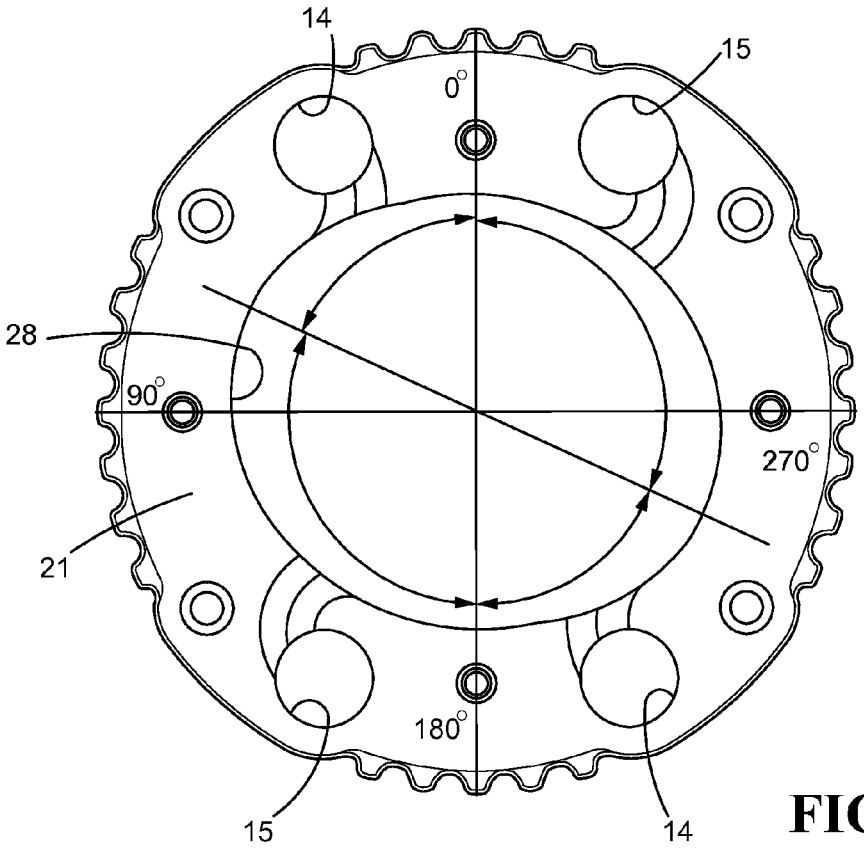
FIG. 7 is a top sectional view of a disclosed pump illustrating a skewed cylindrical rotor disposed within an elliptical cavity.

Returning to FIGS. 5-7, certain advantages of the disclosed design are illustrated. Returning first to FIG. 5, the extension of a vane 27 from completely retracted (0%) to fully extended (100%) is plotted against the rotational angle of 0-360°. The three lines 55, 56, 57 relate to three differently shaped ellipsoidal cavities 28. Specifically, referring to FIG. 6, the solid line 55 is indicative of an ellipsoidal cavity with regular major and minor axes. In other words, the cavity represented by the line 55 is not skewed. The cavities 28 presented by the lines 56, 57 are skewed or altered as shown in FIG. 6.

Specifically, referring to the 0°-90° quadrant, it is clear that the ellipsoidal cavities represented by the lines 56, 57 are larger than the pure ellipsoidal cavity 55. As this is the intake section of the pump 100, more air, gas or fluid is collected at the inlet 14 using this design. Then, referring to the second quadrant 90°-180° of FIG. 6, the reader will note that the cavities represented by the lines 56, 57 are smaller than the regular ellipsoidal cavity 55. As a result, the vane chambers are shrinking as the vanes 27 retract thereby increasing the pressure in the vane chambers as the vane chambers precede toward the outlet 15 at the bottom of the plot, near the 180° mark. In the third quadrant, 180°-270°, where the inlet 14 is disposed, the cavities represented by the lines 56, 57 are larger than the purely ellipsoidal cavity 55 and then the cavities represented by the lines 56, 57 shrink in the fourth quadrant 270°-0° as the vane chambers head toward the outlet 15, at the top of the plot, near the 0° mark. Comparing FIGS. 6 and 7, it is clear that the vanes 27 used in the disclosed cavities represented by the lines 56, 57 rise more in the first quadrant 0°-90°, fall more in the second quadrant 90°-180°, rise more in the third quadrant 180°-270° and fall more in the fourth quadrant 270°-0°.

Figure 8:
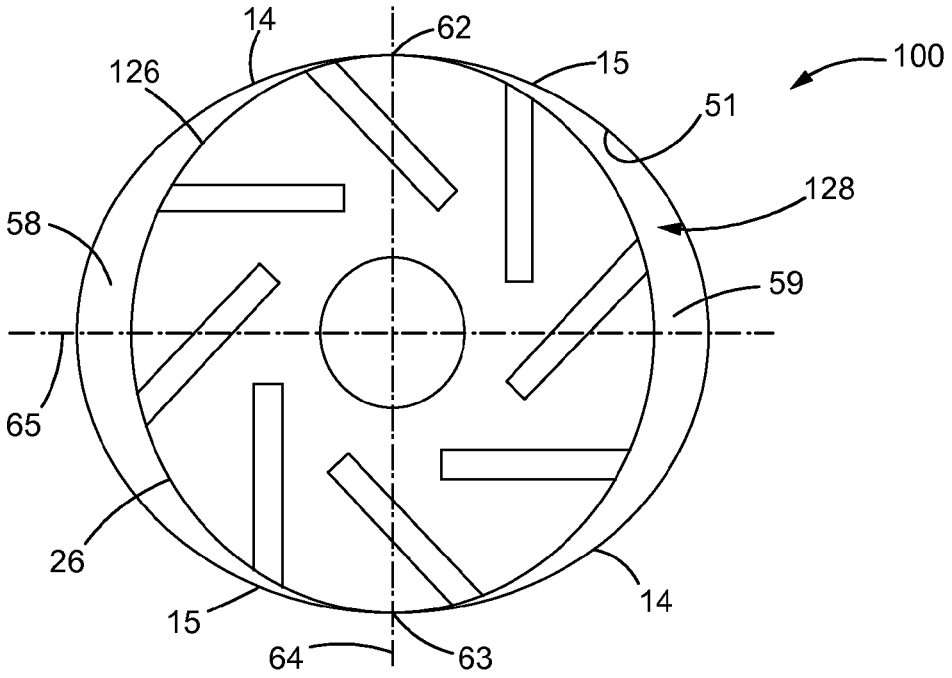
FIG. 8 (Prior Art)
FIG. 8 is a top schematic view of a conventional rotary vane pump with a cylindrical rotor disposed within an elliptical cavity.
Figure 9:
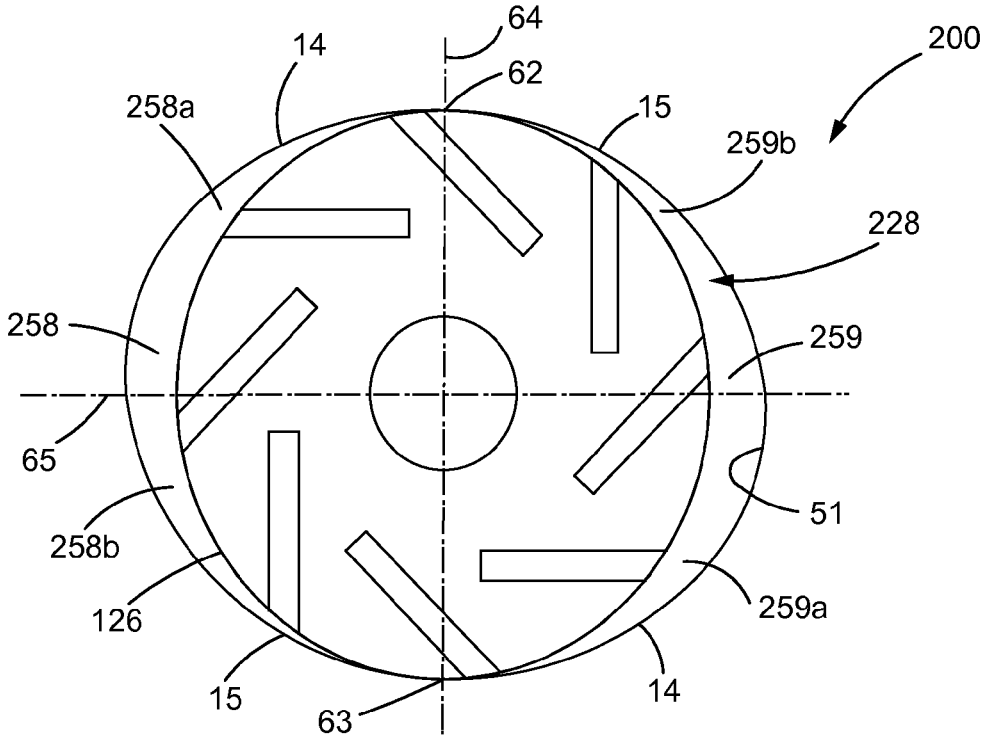
FIG. 9 is a top schematic view of a disclosed rotary vane pump with a skewed elliptical cavity.

This is further illustrated in FIGS. 8-9. FIG. 8 illustrates a purely elliptical cavity 128 with a rotor 126 disposed therein. The pump 100 illustrated in FIG. 8 includes two pump chambers 58, 59 disposed on either side of the rotor 126. The rotor 126 engages the inner wall 51 of the cavity 128 at two points 62, 63, or where the minor axis 64 intersects the inner wall 51. Not only are the pump chambers 58, 59 of the same size, dividing each pump chamber 58, 59 into two using major axis 65 both "halves" of the pump chambers 58, 59 are of equal volume or each quadrant of each pump chamber 58, 59 is of equal volume.

In contrast, turning to FIG. 9, the cavity 228 of the pump 200 is skewed. In other words, while the pump chambers 258, 259 are of the same size, the inlet portion 258*a* of the pump chamber 258 is larger than the outlet portion 258*b*. Similarly, the intake or inlet portion 259*a* of the pump chamber 259 is larger than the outlet portion 259*b*.

Figure 10:
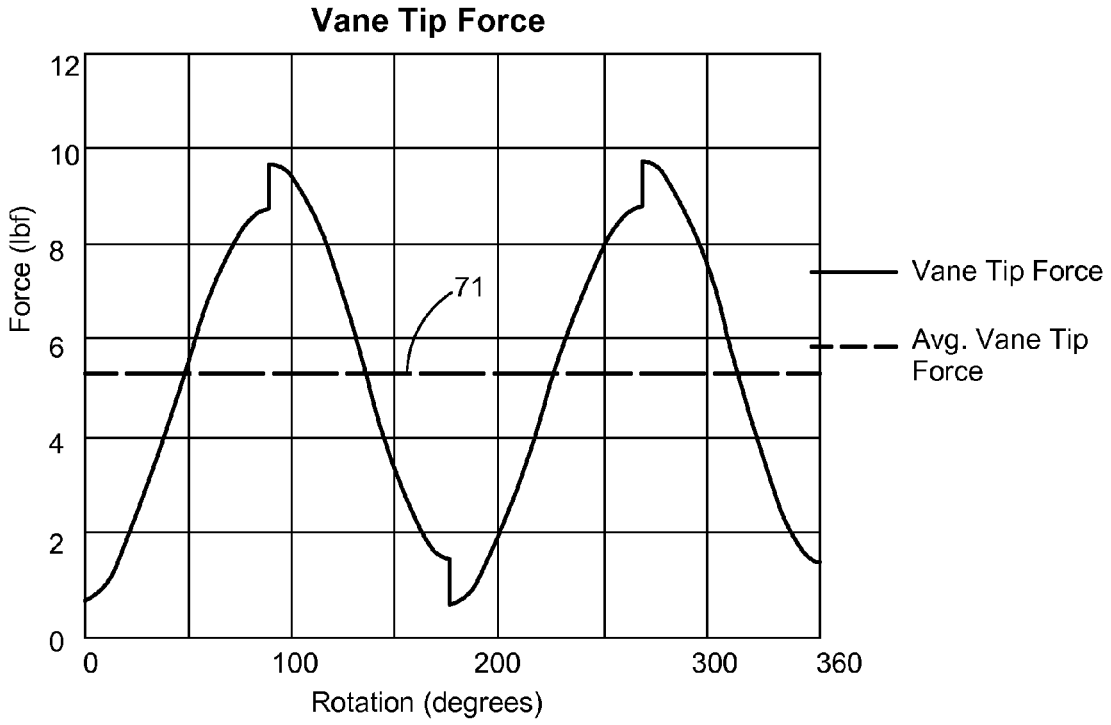
FIG. 10 (Prior Art)
FIG. 10 graphically illustrates the vane tip force and average vane tip force for the conventional pump illustrated in FIG. 8.
Figure 11:
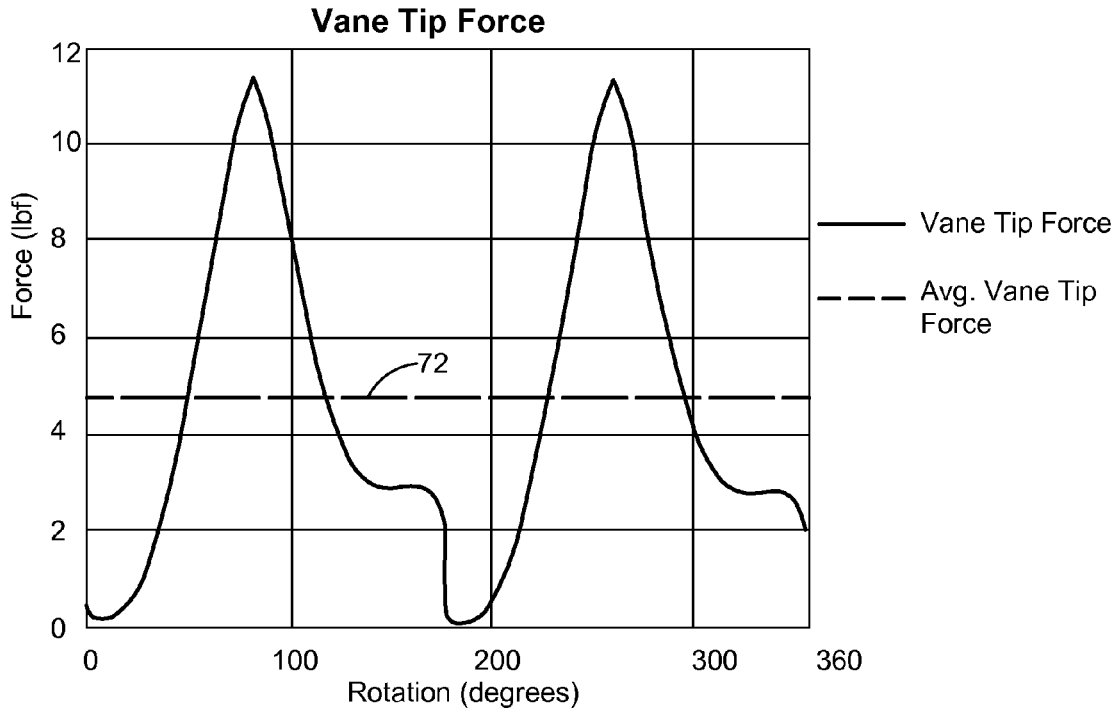
FIG. 11 graphically illustrates the vane tip force and average vane tip force for the disclosed pump of FIG. 9.

The effect of theses geometric changes can be seen in FIGS. 10 and 11. In FIG. 10, the vane tip force versus rotation is plotted for the conventional pump 100 of FIG. 8. In FIG. 11, the vane tip force versus rotation is plotted for the pump 200 of FIG. 9. Note that the average vane tip force represented by the line 71 in FIG. 10 is greater than the average vane tip force represented by the line 72 of FIG. 11, thereby subjecting the vanes 27 of the pump 100 shown in FIG. 8 to greater wear than the vanes of the pump 200 shown in FIG. 9.

Figure 12:
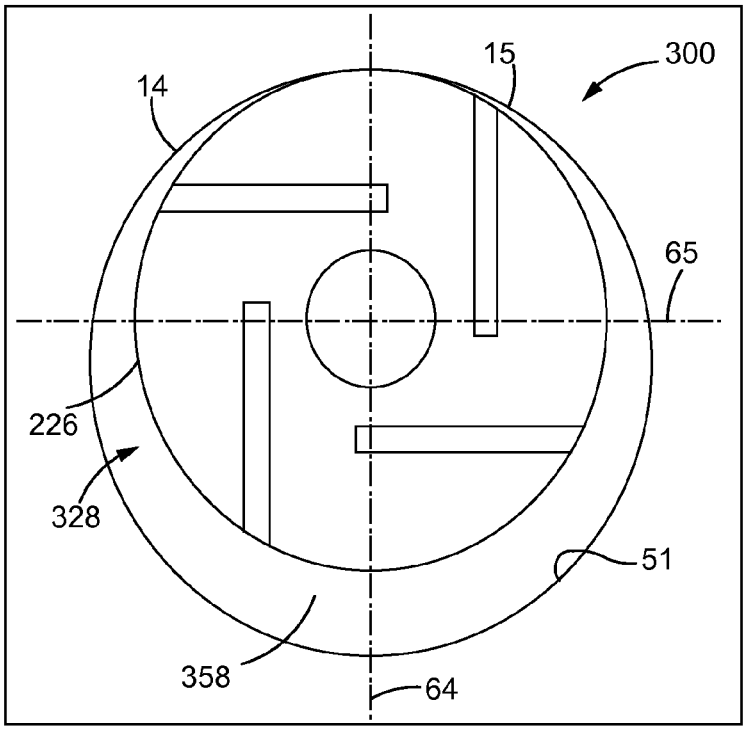
FIG. 12 (Prior Art)
FIG. 12 is a top schematic view of a conventional vane pump with a cylindrical rotor disposed within a cylindrical cavity.
Figure 13:
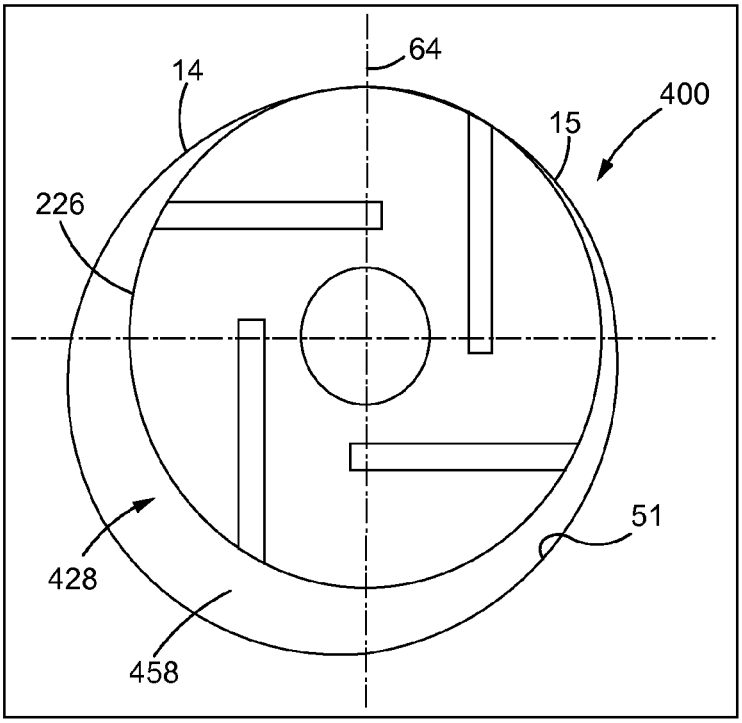
FIG. 13 is a top schematic view of a disclosed rotary vane pump with a cylindrical rotor disposed within a skewed cylindrical cavity.

Similar results are achieved with single chamber pumps like those shown at 300, 400 in FIGS. 12-13. In FIG. 12, the pump 300 features a standard elliptical cavity 328, a cylindrical rotor 226 with slots for four vanes, a single inlet 14 and a single outlet 15. The single pump chamber 358 is of the same size on either side of the minor axis 64 and on either side of the major axis 65. In contrast, turning to FIG. 13, the cavity 428 of the pump 400 is skewed. Even though there is a single pump chamber 458, the pump chamber 458 is substantially larger on the left side of the minor axis 64. Both the upper left and lower left quadrants of the pump chamber 458 are larger than the lower right and upper right quadrants of the pump chamber 458.

Figure 14:
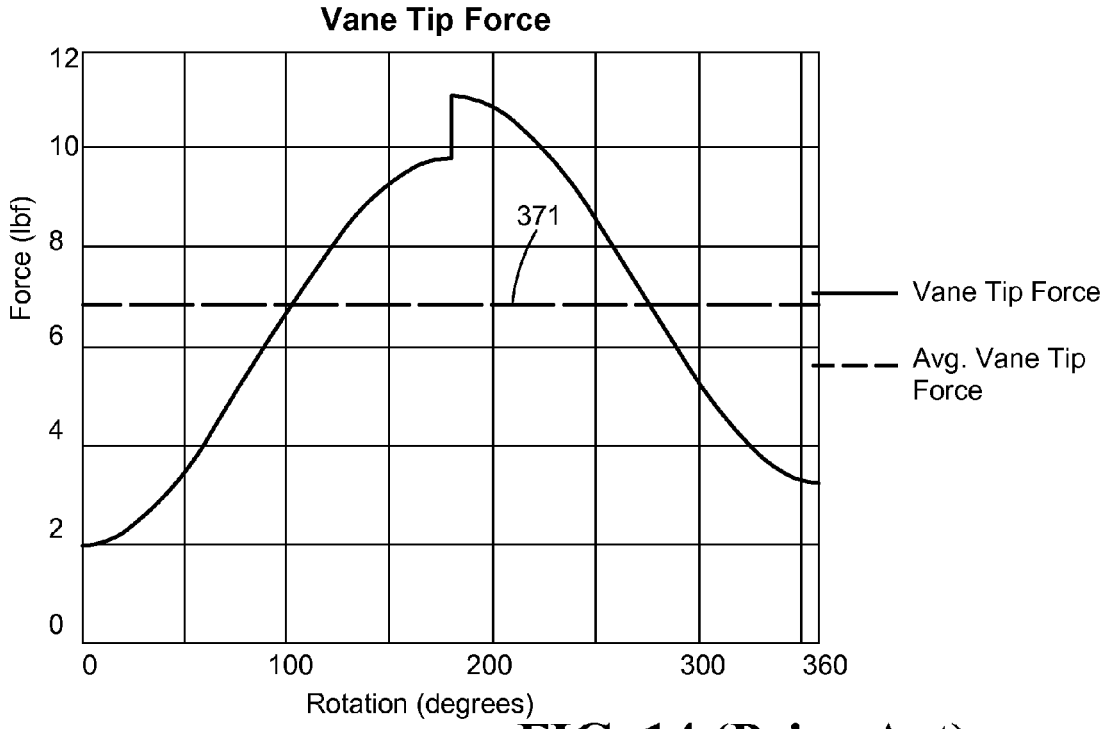
FIG. 14 (Prior Art)
FIG. 14 illustrates, graphically, the vane tip force and average vane tip force for the pump illustrated in FIG. 12.
Figure 15:
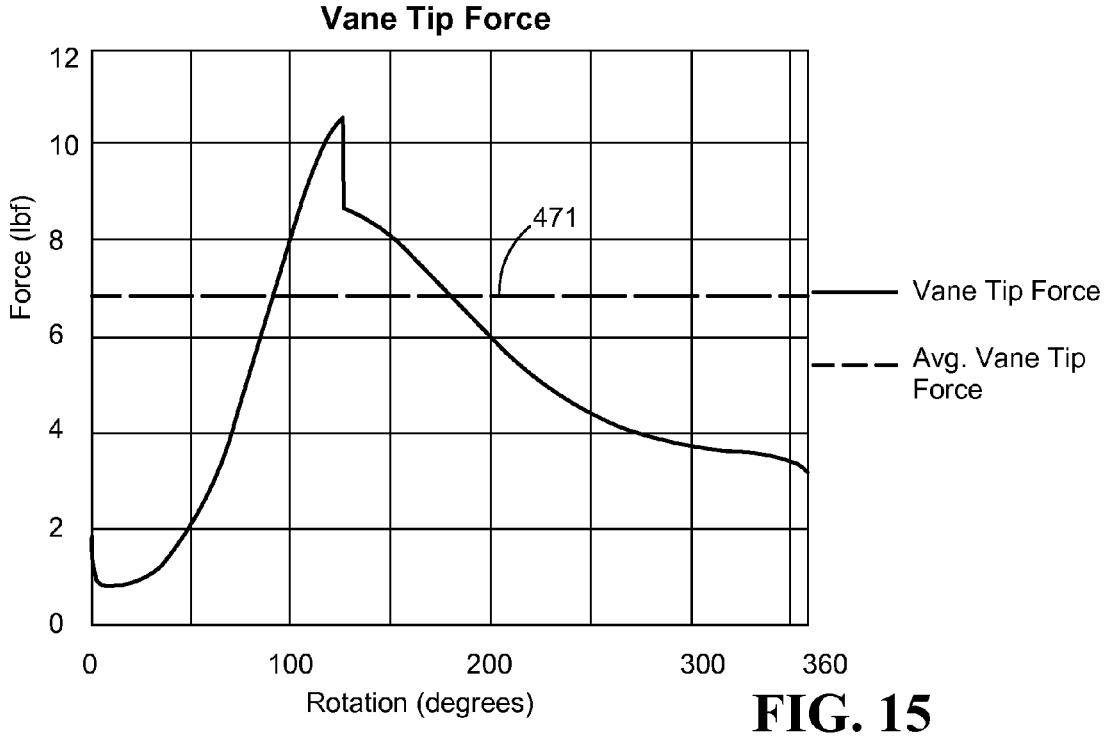
FIG. 15 illustrates, graphically, the vane tip force and average vane tip force for the pump illustrated in FIG. 13.

Turning to FIGS. 14 and 15, the average vane tip force represented by the line 371 in FIG. 14 is about the same as the average vane tip force represented by the line 471 in FIG. 15. Thus, for single chamber pumps like those shown at 300, 400, the modifications can be made without sacrificing vane life.

Figure 16:
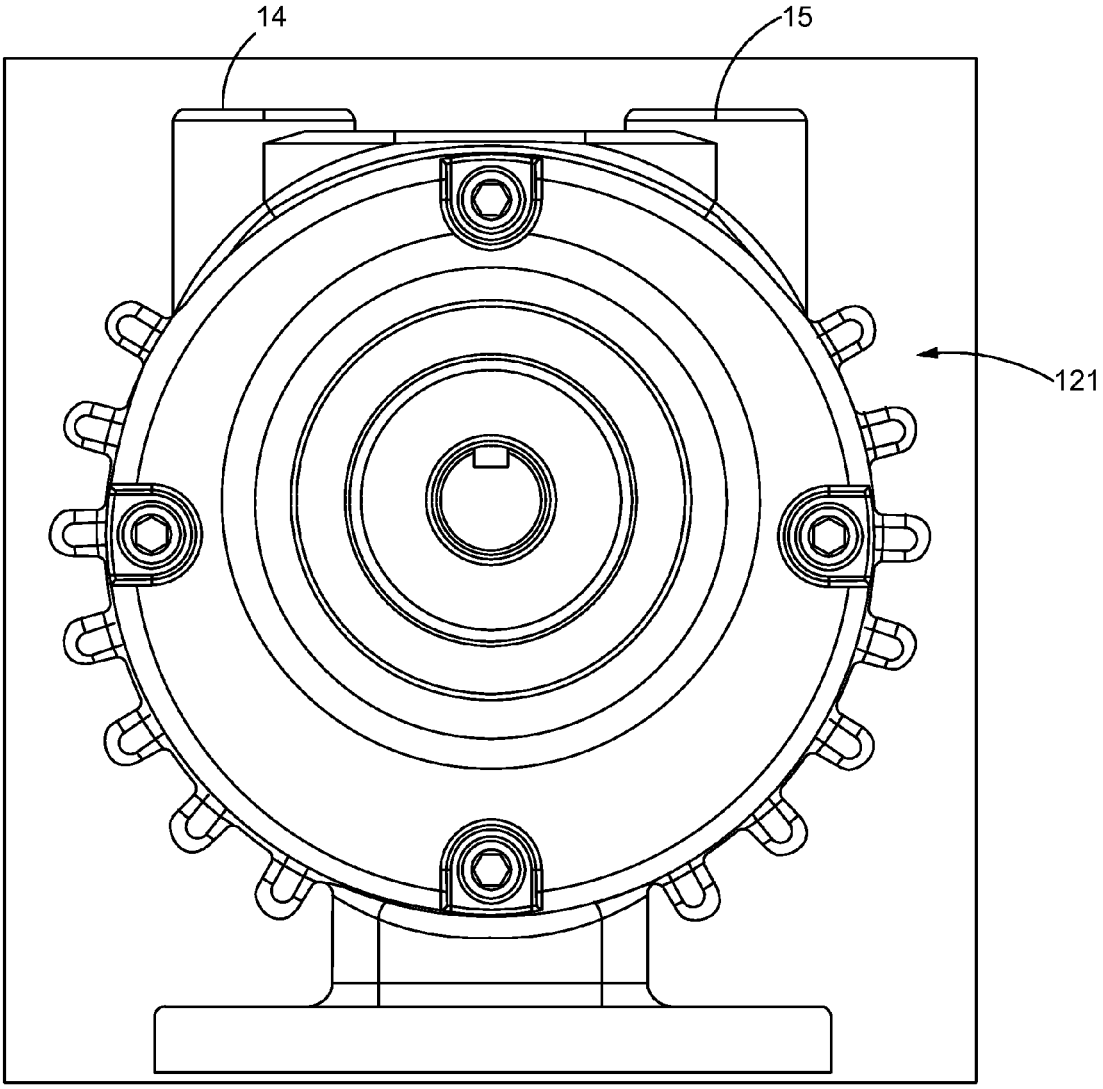
FIG. 16 is a front plan view of yet another disclosed rotary vane pump, particularly illustrating the outer casing.
Figure 17:
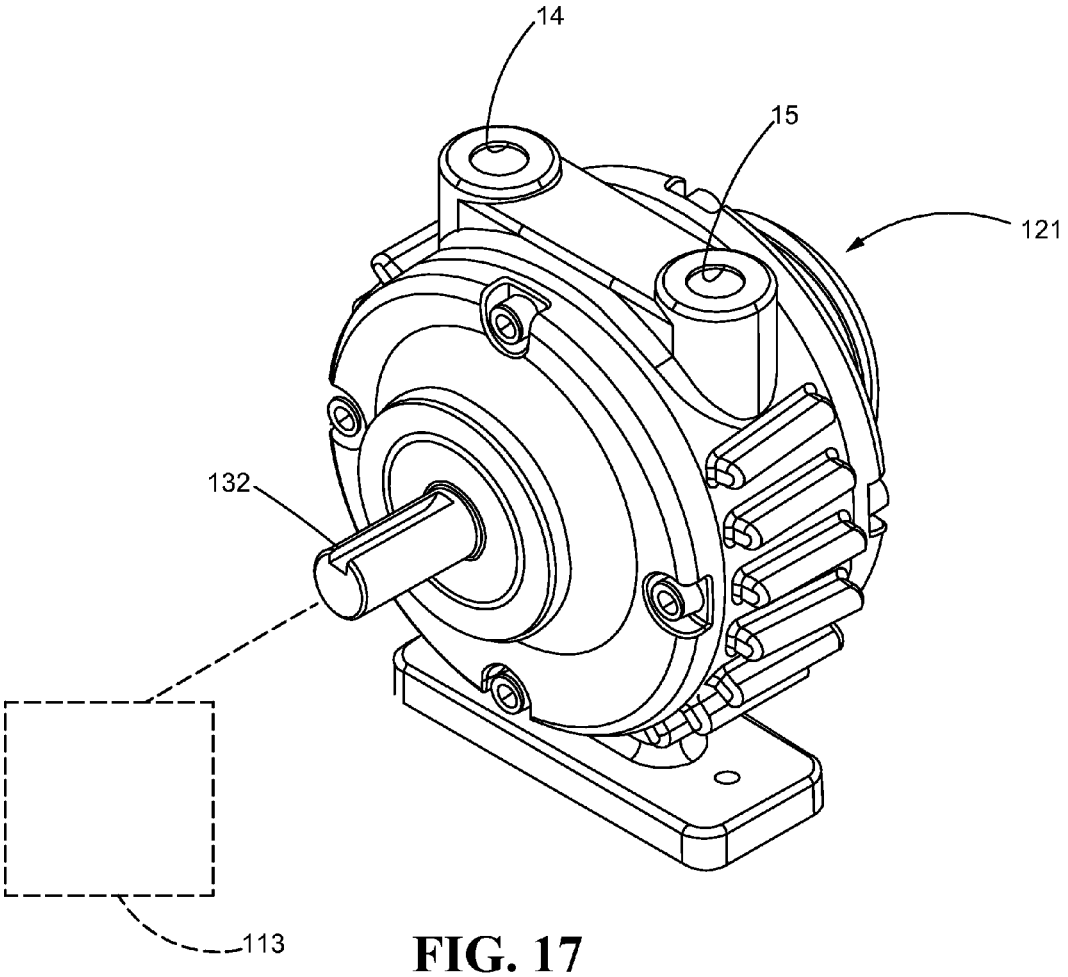
FIG. 17 is a perspective view of the pump illustrated in FIG. 16, schematically illustrating the direct or indirect coupling of the pump to a motor.
Figure 18:
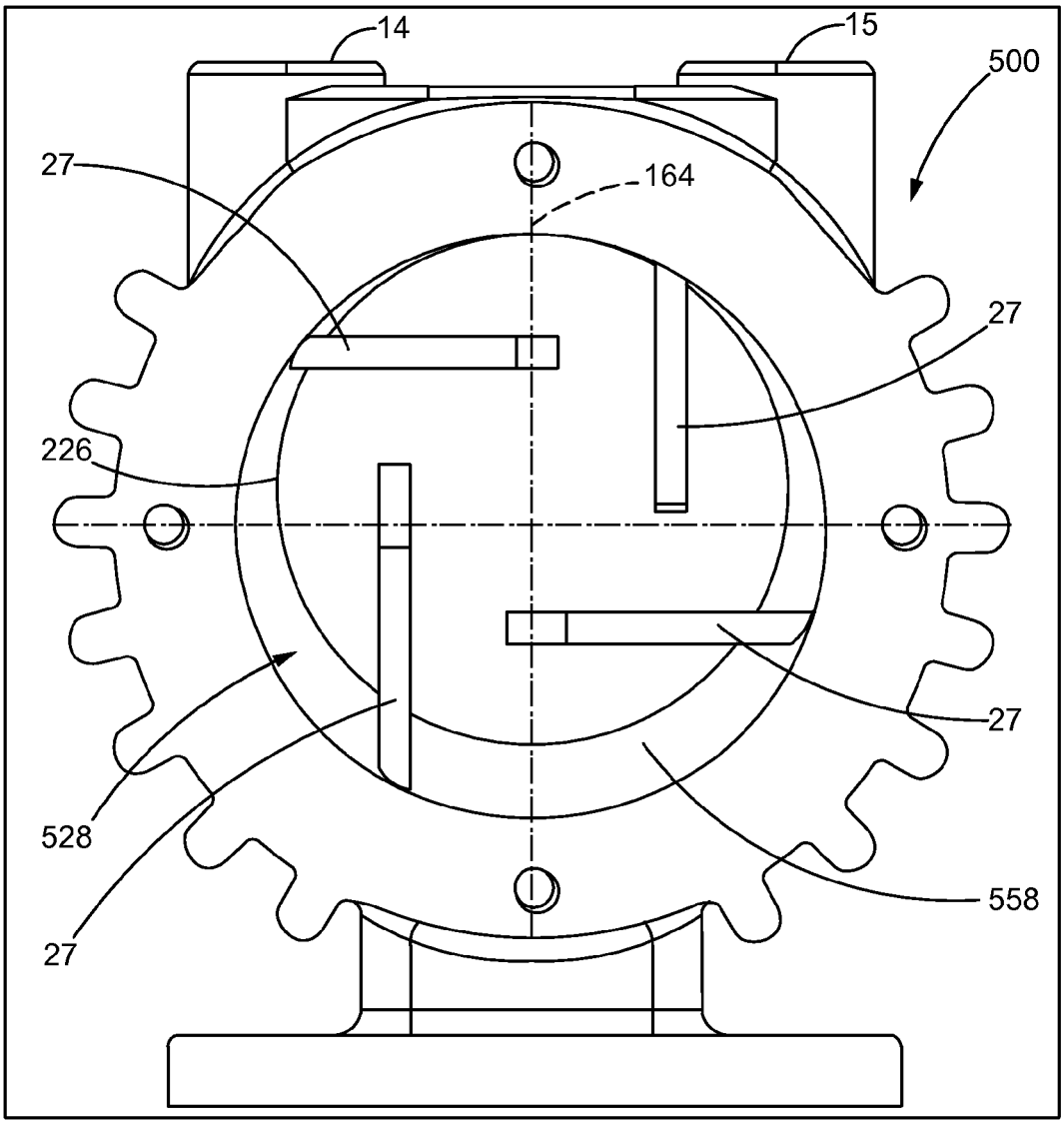
FIG. 18 (Prior Art)
FIG. 18 is a front plan view of a conventional vane pump with a cylindrical rotor disposed within a cylindrical cavity.
Figure 19:
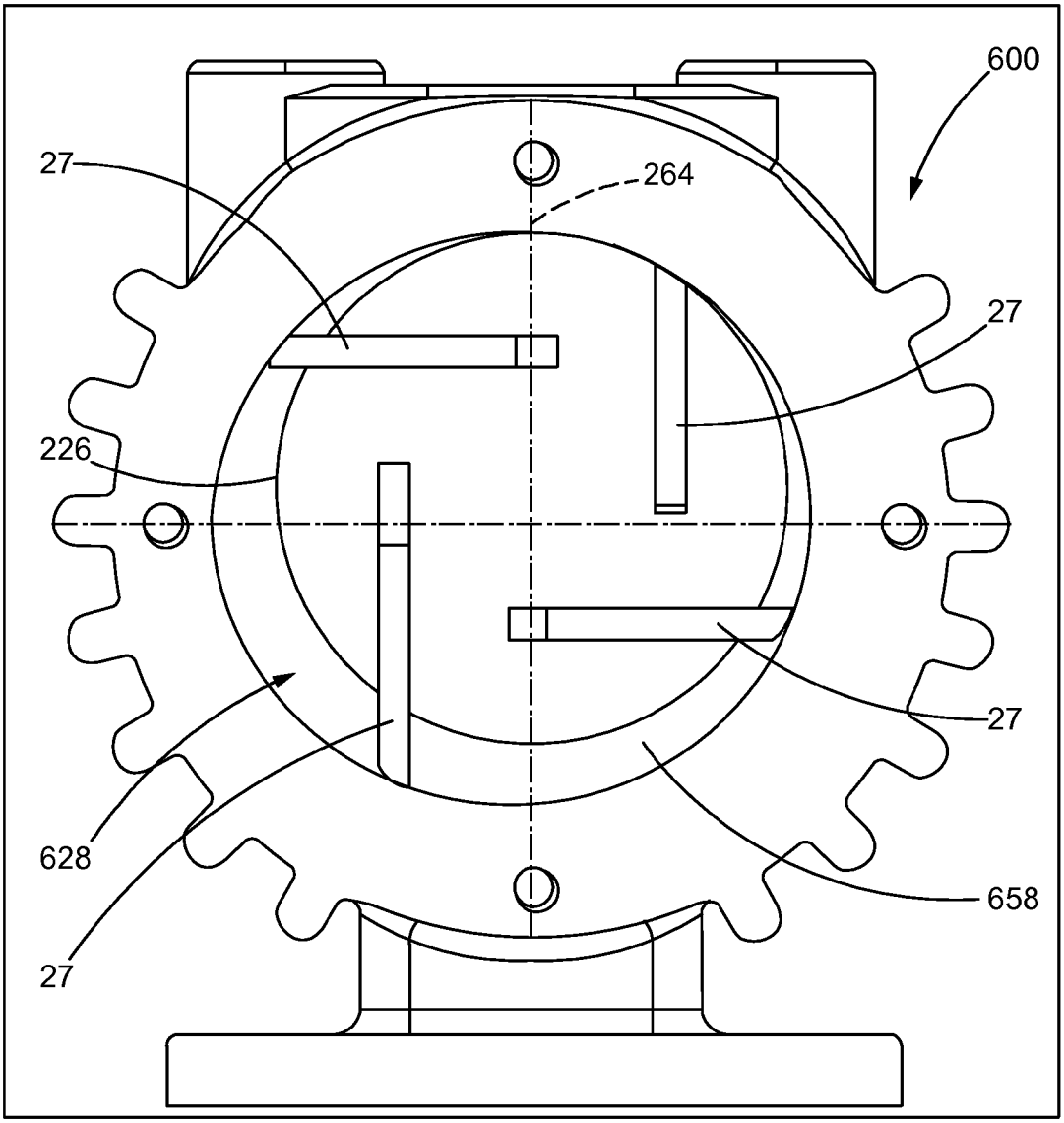
FIG. 19 is a front plan view of the disclosed rotary vane pump with a cylindrical rotor disposed within a skewed cylindrical cavity.
Figure 22:
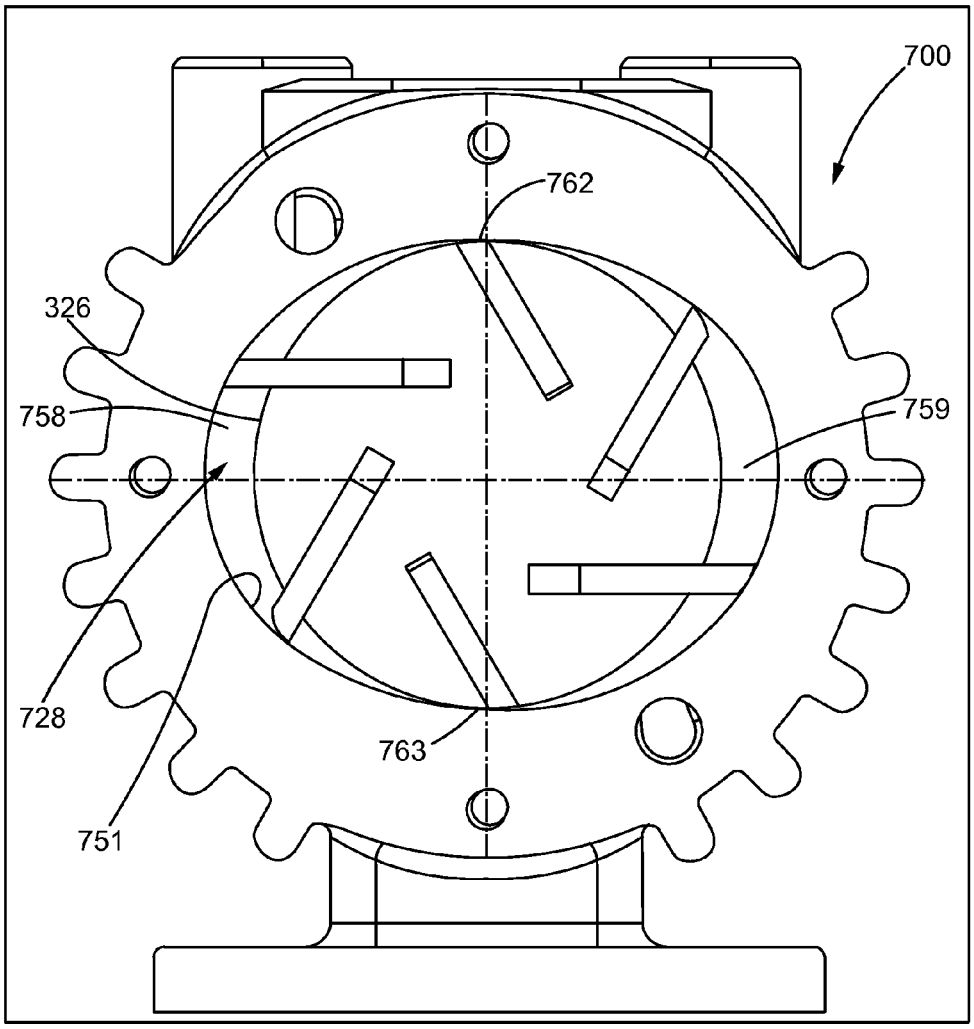
FIG. 22 (Prior Art)
FIG. 22 is a front plan view of a conventional vane pump with a cylindrical rotor disposed within an elliptical cavity.
Figure 23:
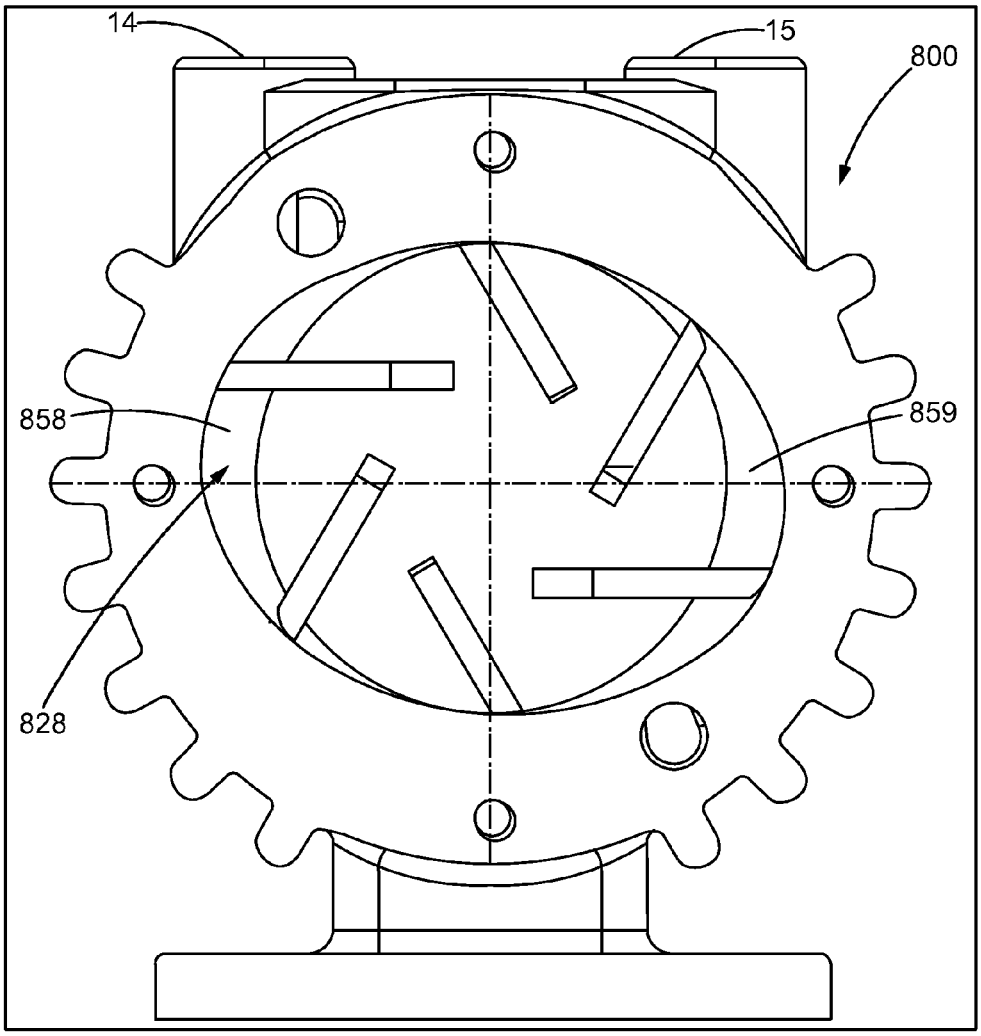
FIG. 23 is a front plan view of the disclosed rotary vane pump with a cylindrical rotor disposed within a skewed elliptical cavity.
Figure 24:
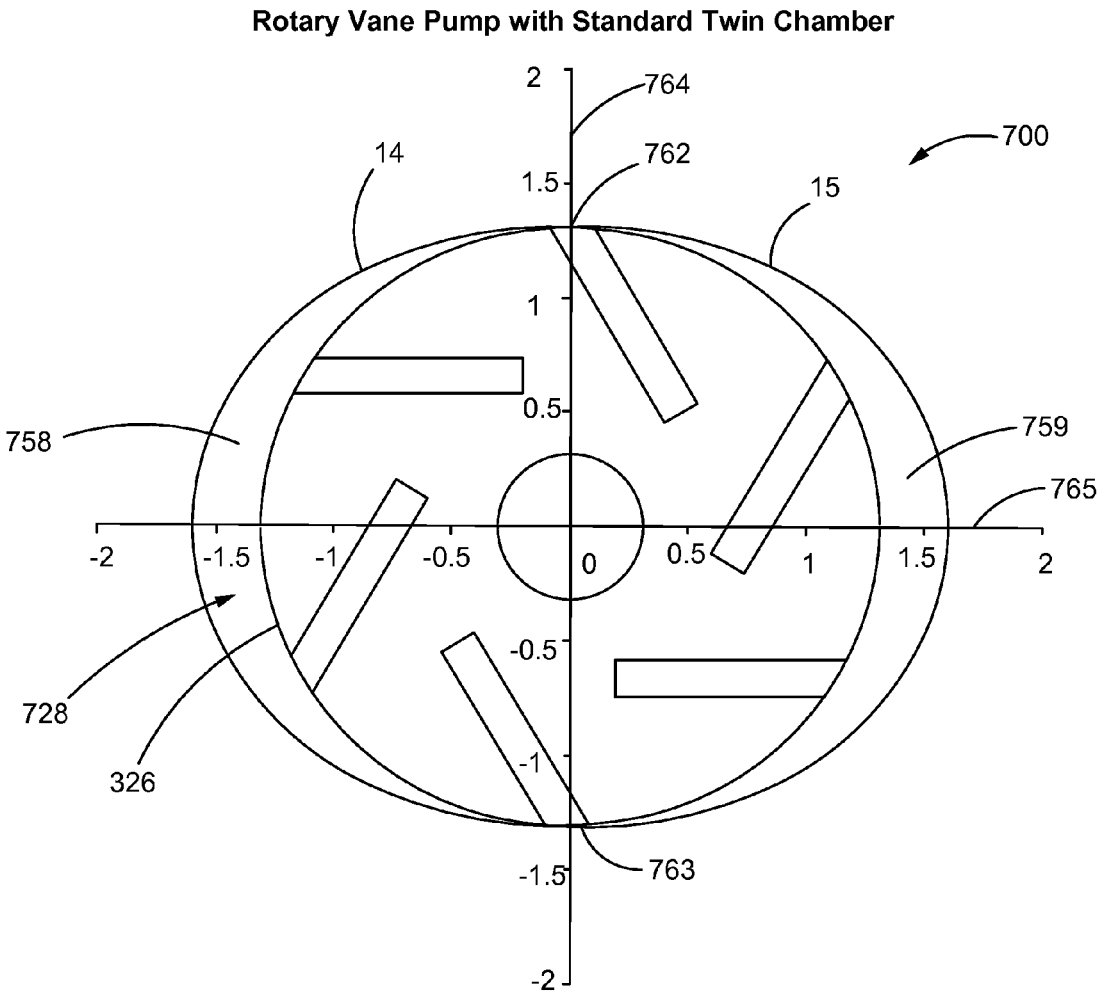
FIG. 24 (Prior Art)
FIG. 24 is a front schematic view of the conventional vane pump with a cylindrical rotor disposed within an elliptical cavity as shown in FIG. 22.
Figure 25:
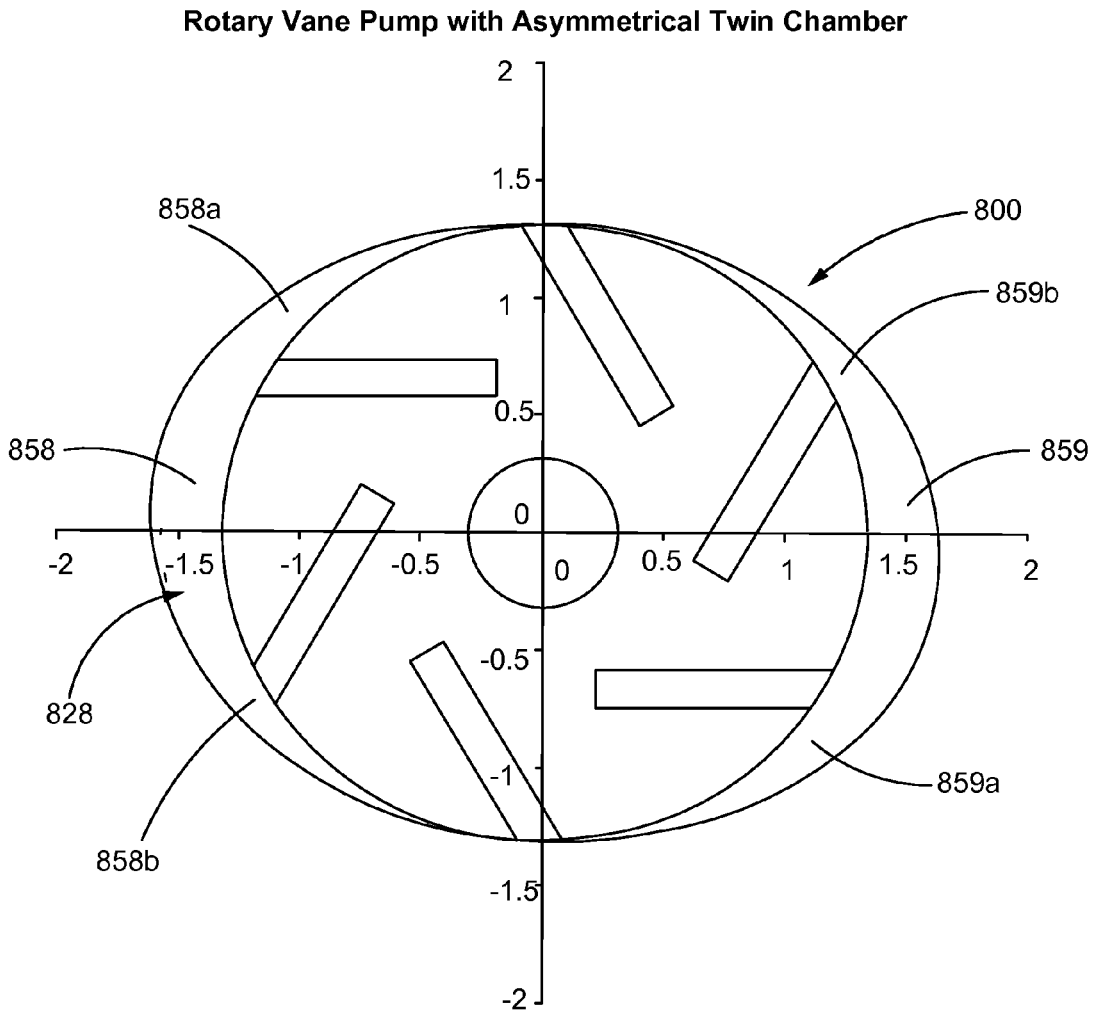
FIG. 25 is a top schematic view of a disclosed rotary vane pump with a cylindrical rotor disposed within a skewed elliptical cavity as shown in FIG. 23.

FIGS. 16-17 illustrate a casing 121 that can be utilized for conventional pumps 500, 700 of FIGS. 18, 22 and 24 or the disclosed pumps 600, 800 of FIGS. 19, 23 and 25. FIG. 17 illustrates the versatility that can be employed in terms of providing a rotational power source. Specifically, a motor 113 is shown schematically that may be coupled directly or indirectly to the rotor shaft 132. The casing 121 also includes a single inlet 14 and a single outlet 15.

Turning to FIGS. 18-21, similar results are again achieved with single chamber pumps like those shown at 500, 600 in FIGS. 18-19. In FIG. 18, the pump 500 features a standard cylindrical cavity 528, a single inlet 14 and a single outlet 15. The single pump chamber 558 is of the same size on either side of the axis 164 and on either side of the axis 165. In contrast, turning to FIG. 19, the asymmetrical cylindrical cavity 628 of the pump 600 is skewed. Even though there is a single pump chamber 658, the pump chamber 658 is substantially larger on the left side of the axis 264. Both the upper left and lower left quadrants of the pump chamber 658 are larger than the lower right and upper right quadrants of the pump chamber 658.

Figure 20:
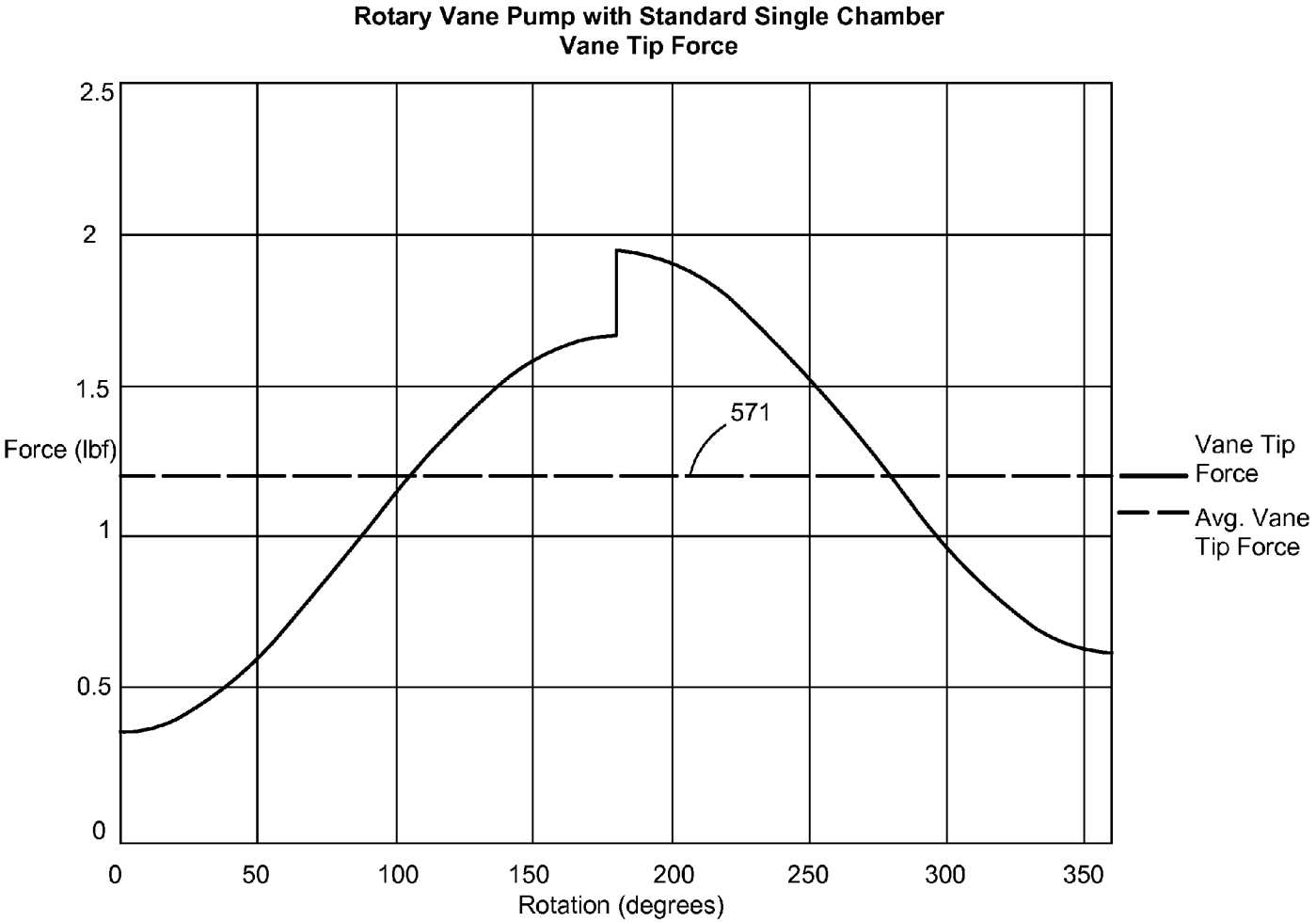
FIG. 20 (Prior Art)
FIG. 20 illustrates, graphically, the vane tip force and average vane tip force for the pump illustrated in FIG. 18.
Figure 21:
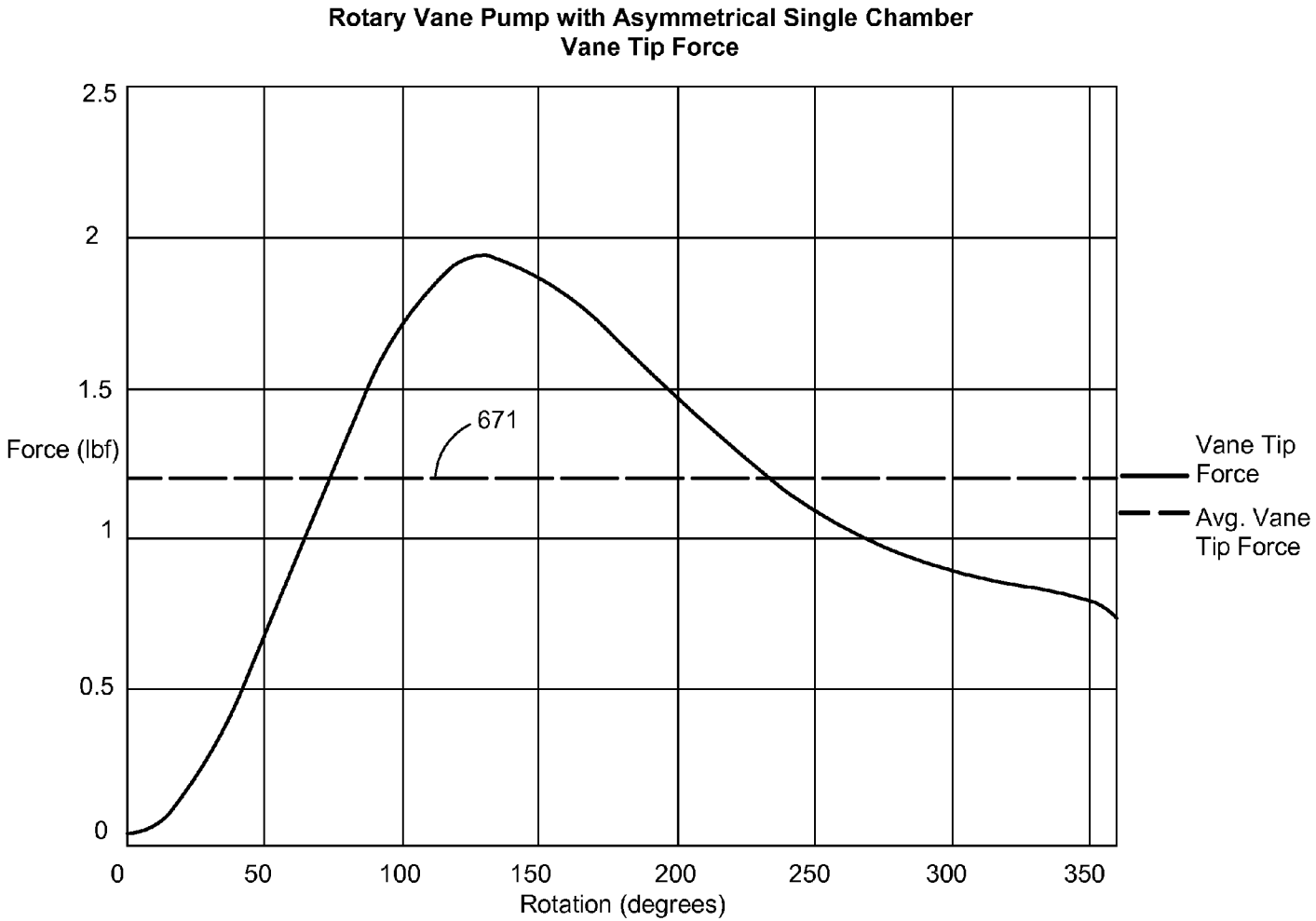
FIG. 21 illustrates, graphically, the vane tip force and average vane tip force for the pump illustrated in FIG. 19.

Turning to FIGS. 20 and 21, the average vane tip force represented by the line 571 in FIG. 20 is about the same as the average vane tip force represented by the line 671 in FIG. 21. Thus, for single chamber pumps like those shown at 500, 600 in FIGS. 18-19 and like those shown at 300, 400 in FIGS. 12, 13, the modifications can be made without sacrificing vane life. Further, the reader will also note that vane tip bouncing or skipping indicated at 173 in FIG. 20 has been eliminated by the pump 600 as shown in FIG. 21.

FIGS. 22 and 24 illustrates a purely elliptical cavity 728 with a rotor 326 disposed therein. The pump 700 illustrated in FIG. 22 includes two pump chambers 758, 759 disposed on either side of the rotor 326. The rotor 326 engages the inner wall 751 of the cavity 728 at two points 762, 763, or where the minor axis 764 intersects the inner wall 751. Not only are the pump chambers 758, 759 of the same size, dividing each pump chamber 758, 759 into two using major axis 765 both "halves" of the pump chambers 758, 759 are of equal volume or each quadrant of each pump chamber 758, 759 is of equal volume.

Figure 26:
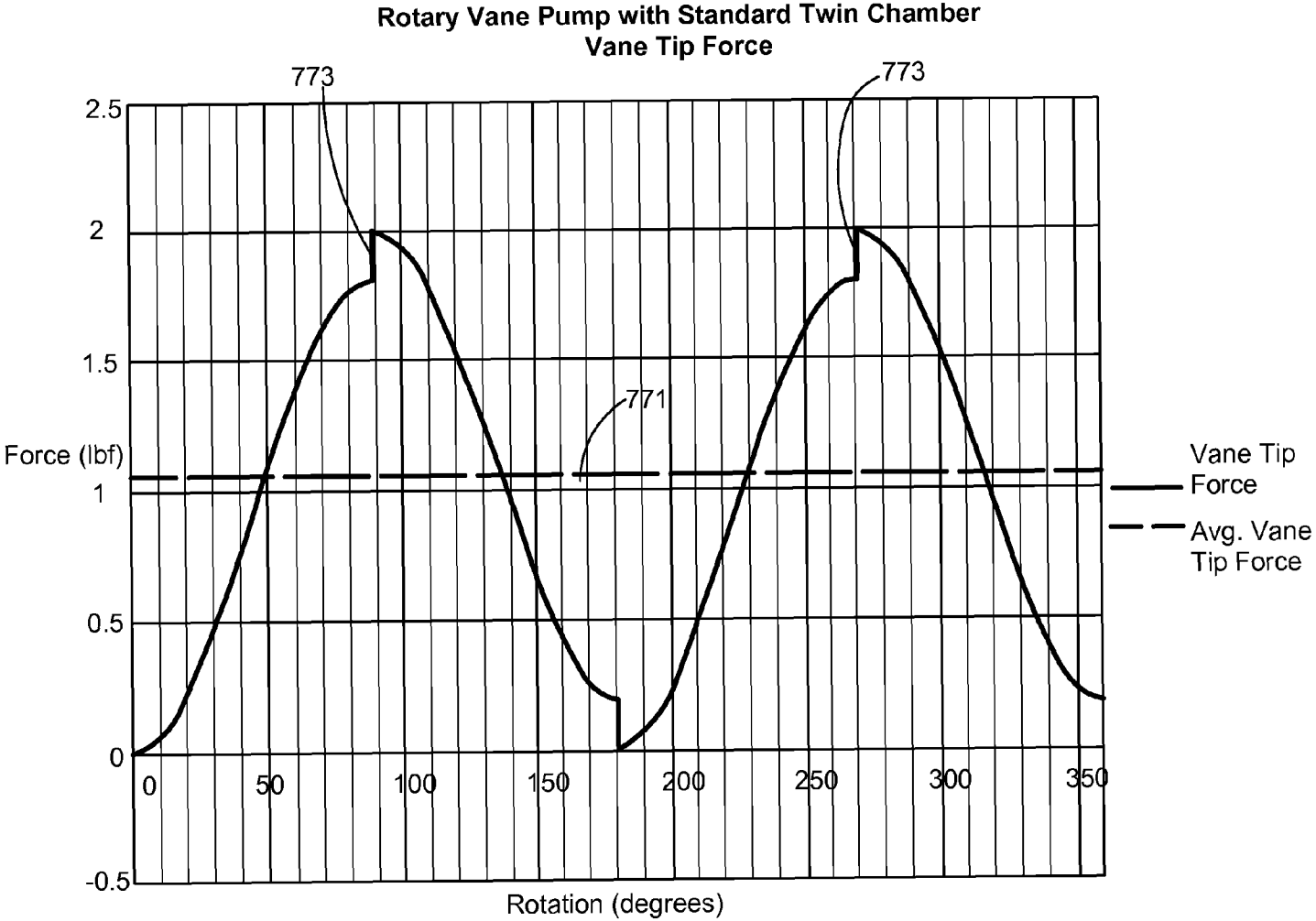
FIG. 26 (Prior Art)
FIG. 26 illustrates, graphically, the vane tip force and average vane tip force for the conventional pump illustrated in FIGS. 22 and 24.
Figure 27:
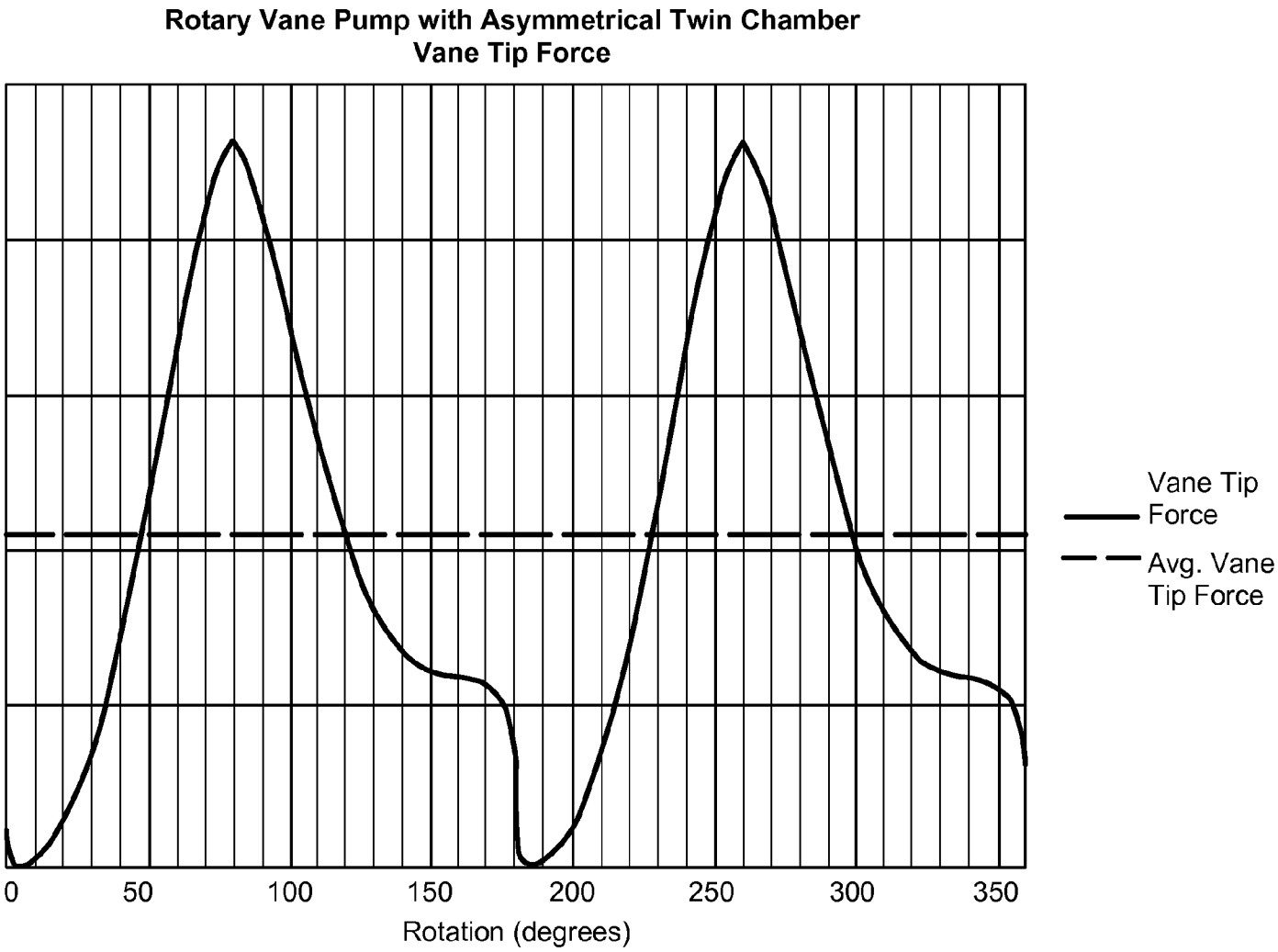
FIG. 27 illustrates, graphically, the vane tip force and average vane tip force for the disclosed rotary vane pump illustrated in FIGS. 23 and 25.

In contrast, turning to FIGS. 23 and 25, the cavity 828 of the pump 800 is skewed. In other words, while the pump chambers 858, 859 are of the same size, the inlet portion 858*a* of the pump chamber 858 is larger than the outlet portion 858*b*. Similarly, the intake or inlet portion 859*a* of the pump chamber 859 is larger than the outlet portion 859*b*. The effect of theses geometric changes can be seen in FIGS. 26 and 27. In FIG. 26, the vane tip force versus rotation is plotted for the conventional pump 700 of FIGS. 22 and 24. In FIG. 27, the vane tip force versus rotation is plotted for the pump 800 of FIGS. 23 and 25. Note that the average vane tip force represented by the line 771 in FIG. 26 is about the same as the average vane tip force represented by the line 871 of FIG. 27.

INDUSTRIAL APPLICABILITY

By shifting the angle of maximum vane extension closer to the intake (skewing the circular single chamber or ellipsoidal or oval twin chamber), the angular distance between the intake and exhaust is increased allowing greater internal compression. Further adjustment of the chamber curvature allows optimization of the vane acceleration where the average vane tip load can be reduced and vane "skipping" can be eliminated. The resulting pump is more quiet, cool, and efficient and that has longer vane life.

Referring back to FIGS. 5-6, by way of example only, following methodology may be used in generating the skewed ellipsoidal cavities represented by the lines 56, 57. If, L=distance from center;

$D_{minor}$=minor diameter;

d=maximum radial extension;

A=angle at maximum radial extension (less than or equal to 90°);

a=angle (0 to 360°);

b=skewed angle; and g=curvature factor (the curvature factor may be varied along the curve as needed to refine the bore shape), then the following asymmetrical bore shape equations apply:

$$b_{a=0\ to\ A^\circ}=a*90/A$$

$$b_{a=A\ to\ 180^\circ}=a+(90-A)*(180-a)/(180-A)$$

$$b_{a=180\ to\ 180+A^\circ}=180+(a-180)*90/A$$

$$b_{a=180+A\ to\ 360^\circ}=a+(90-A)*(360-a)/(180-A)$$

$$L=d*|\mathrm{SIN}(b)|^g D_{minor}/2$$

The rise and fall of a vane 27 for an elliptical cavity is $d*\mathrm{SIN}(a)^2$ while the rise and fall of a vane 27 in a skewed elliptical body is $d*|\mathrm{SIN}(b)|^g$. Other mathematical techniques for generating various skewed ellipsoidal cavity shapes will be apparent to those skilled in the art. Further, the ellipsoidal cavities shown in the figures may be varied without departing from the scope of this disclosure.

What is claimed is:

1. A rotary vane pump comprising:

a casing comprising an asymmetrical cavity having a continuous inner wall, the cavity having a minor axis and a major axis;

a rotor disposed within the cavity for rotation within the cavity, during a rotation, two diametrically opposed portions of the rotor abut or nearly abut the inner wall of the cavity at or near the minor axis of the cavity while two portions of the rotor and inner wall are not in contact with each other thereby defining two pump chambers disposed on opposite sides of the minor axis;

each pump chamber comprising an inlet end and an outlet end, the inlet ends disposed in different pump chambers on opposite sides of the minor axis and on opposite sides of the major axis, the outlet ends disposed in different pump chambers on opposite sides of the minor axis and on opposite sides of the major axis;

each pump chamber being larger in volume between the inlet end and major axis than between the major axis and the outlet end.

2. The pump of claim 1 wherein the rotor comprises a plurality of slots ranging from 3 to 12 with each slot accommodating a vane.

3. The pump of claim 2 wherein the rotor comprises 8 slots and 8 vanes.

4. The pump of claim 1 wherein an angle between each of the two diametrically opposed portions of the rotor abut or nearly abut the inner wall of the cavity at or near the minor axis of the cavity and the inner wall of the cavity in each chamber where each vane is fully extended as it engages the inner wall ranges from less than 90° to about 50°.

5. The pump of claim 4 wherein the angle where each vane is fully extended as it engages the inner wall is about 80°.

6. The pump of claim 1 wherein the rotor is cylindrically shaped.

7. The pump of claim 1 wherein the cavity is an asymmetrical elliptically shaped cavity.

8. A method of increasing internal compression of a rotary vane pump, the method comprising:

providing a casing comprising an asymmetrical cavity having a continuous inner wall, the cavity having a minor axis and a major axis;

disposing a rotor within the cavity for rotation within the cavity so that, during a rotation, two diametrically opposed portions of the rotor abut or nearly abut the inner wall of the cavity at or near the minor axis of the cavity while two portions of the rotor and inner wall are not in contact with each other thereby defining two pump chambers disposed on opposite sides of the minor axis;

providing each pump chamber with an inlet end and an outlet end, the inlet ends disposed in different pump chambers on opposite sides of the minor axis and on opposite sides of the major axis, the outlet ends disposed in different pump chambers on opposite sides of the minor axis and on opposite sides of the major axis; and shaping the asymmetrical cavity so each pump chamber is larger in volume between the inlet end and major axis than between the major axis and the outlet end.

9. The method of claim 8 wherein the rotor comprises a plurality of slots ranging from 3 to 12 with each slot accommodating a vane.

10. The method of claim 8 wherein an angle between each of the two diametrically opposed portions of the rotor abutting or nearly abutting the inner wall of the cavity at or near the minor axis of the cavity and the inner wall of the cavity in each chamber where each vane is fully extended as it engages the inner wall ranges from less than 90° to about 50°.

11. The method of claim 10 wherein the angle where each vane is fully extended as it engages the inner wall is about 80°.

* * * * *